US008432277B2

(12) United States Patent
Egawa et al.

(10) Patent No.: US 8,432,277 B2
(45) Date of Patent: Apr. 30, 2013

(54) ALARM DEVICE AND ALARM SYSTEM

(75) Inventors: Yoshitaka Egawa, Tokyo (JP); Isao Asano, Zama (JP); Hiroshi Shima, Yokohama (JP)

(73) Assignee: Hochiki Corporation, Tokyo (JP)

( * ) Notice: Subject to any disclaimer, the term of this patent is extended or adjusted under 35 U.S.C. 154(b) by 316 days.

(21) Appl. No.: 12/745,915

(22) PCT Filed: Oct. 1, 2008

(86) PCT No.: PCT/JP2008/067855

§ 371 (c)(1),
(2), (4) Date: Aug. 10, 2010

(87) PCT Pub. No.: WO2009/072344

PCT Pub. Date: Jun. 11, 2009

(65) Prior Publication Data

US 2010/0295677 A1 Nov. 25, 2010

(30) Foreign Application Priority Data

Dec. 6, 2007 (JP) ..... 2007-315976
Apr. 28, 2008 (JP) ..... 2008-002726 U
Apr. 28, 2008 (JP) ..... 2008-116708

(51) Int. Cl.
*G08B 21/00* (2006.01)

(52) U.S. Cl.
USPC ..... 340/540; 340/571; 340/573.1; 340/628; 340/541; 340/686.6; 700/32; 709/201; 713/323; 600/347; 379/39; 378/57; 362/20; 361/59; 342/28

(58) Field of Classification Search ..... 340/541, 340/321, 506, 571, 628, 502, 531, 539.11, 340/573.1; 600/347; 379/39; 362/20; 713/323; 342/28; 700/32; 361/59; 250/336.1; 307/141; 709/201; 378/57
See application file for complete search history.

(56) References Cited

U.S. PATENT DOCUMENTS 3,492,426 A * 1/1970 Foreman et al. ..... 379/39
3,495,231 A * 2/1970 Shimizu et al. ..... 340/502
5,854,520 A * 12/1998 Buck et al. ..... 307/141
6,265,970 B1 * 7/2001 Whitehead ..... 340/506
6,400,265 B1 * 6/2002 Saylor et al. ..... 340/531

(Continued)

FOREIGN PATENT DOCUMENTS

JP 61065398 A 4/1986
JP 02014400 A 1/1990

(Continued)

OTHER PUBLICATIONS

Office Action issued in Japanese Patent Application No. 2007-315976, mailed Mar. 8, 2012, 5 pages.

(Continued)

*Primary Examiner* — Daniel Wu
*Assistant Examiner* — Israel Daramola
(74) *Attorney, Agent, or Firm* — Wood, Herron & Evans, L.L.P.

(57) ABSTRACT

An alarm device includes: a detection device which detects an occurrence of an abnormal condition within a monitoring area; a transmission device which transmits an alarm signal when the detection device detects the abnormal condition; and an output device which, after the transmission device has transmitted the alarm signal, outputs an alarm after a lapse of a predetermined time after the transmission.

10 Claims, 27 Drawing Sheets

U.S. PATENT DOCUMENTS

| | | | | |
|---|---|---|---|---|
| 7,456,734 | B2 * | 11/2008 | Lenshin et al. | 340/539.11 |
| 7,868,812 | B2 * | 1/2011 | Huthoefer et al. | 342/28 |
| 7,873,849 | B2 * | 1/2011 | Mucignat et al. | 713/323 |
| 7,878,668 | B2 * | 2/2011 | Martinez | 362/20 |
| 7,880,591 | B2 * | 2/2011 | Johnson et al. | 340/321 |
| 7,880,604 | B2 * | 2/2011 | McKenna et al. | 340/506 |
| 7,880,612 | B2 * | 2/2011 | Caswell | 340/571 |
| 7,889,088 | B1 * | 2/2011 | Billman | 340/628 |
| 2008/0291036 | A1 * | 11/2008 | Richmond | 340/628 |
| 2009/0115588 | A1 * | 5/2009 | Stahel et al. | 340/438 |
| 2009/0204235 | A1 * | 8/2009 | Dubinsky | 700/32 |
| 2009/0212943 | A1 * | 8/2009 | Burnard et al. | 340/541 |
| 2009/0212945 | A1 * | 8/2009 | Steen | 340/541 |
| 2009/0213510 | A1 * | 8/2009 | Klein et al. | 361/59 |
| 2009/0213989 | A1 * | 8/2009 | Harding | 378/57 |
| 2009/0216102 | A1 * | 8/2009 | Say et al. | 600/347 |
| 2009/0216830 | A1 * | 8/2009 | Inoue et al. | 709/201 |
| 2009/0230305 | A1 * | 9/2009 | Burke et al. | 250/336.1 |
| 2009/0322548 | A1 * | 12/2009 | Gottlieb | 340/686.6 |
| 2010/0265073 | A1 * | 10/2010 | Harper | 340/573.1 |

FOREIGN PATENT DOCUMENTS

| | | | |
|---|---|---|---|
| JP | 09147279 | A | 6/1997 |
| JP | 10-302168 | | 11/1998 |
| JP | 11066467 | A | 3/1999 |
| JP | 11115686 | A | 4/1999 |
| JP | 2000020844 | A | 1/2000 |
| JP | 2000-322674 | | 11/2000 |
| JP | 2001-016663 | | 1/2001 |
| JP | 2002-042280 | | 2/2002 |
| JP | 2002042285 | A | 2/2002 |
| JP | 2003-346107 | | 12/2003 |
| JP | 2005292969 | A | 10/2005 |
| JP | 2006018597 | A | 1/2006 |
| JP | 2007-094719 | | 4/2007 |
| JP | 2007-213507 | | 8/2007 |
| JP | 2007233679 | A | 9/2007 |
| JP | 2007-266824 | | 10/2007 |

OTHER PUBLICATIONS

Japanese Patent Office; Search Report in International Patent Application No. PCT/JP2008/067855 dated Jan. 13, 2009.

* cited by examiner

ALARM DEVICE AND ALARM SYSTEM

BACKGROUND OF THE INVENTION

1. Field of the Invention

The present invention relates to an alarm device and alarm system which detects an abnormal condition such as a fire and emits an alarm, and also wirelessly transmits an alarm signal to other alarm devices to facilitate linked alarm output.

Priority is claimed on Japanese Patent Application No. 2007-315976, Japanese Patent Application No. 2008-116708, and Utility Model Application No. 2008-002726, the contents of which are incorporated herein by reference.

2. Description of Related Art

[First Background Art]

Conventionally, alarm devices such as fire alarms and gas detectors have been used which detect an abnormal condition such as a fire or gas leak and emit an alarm. Furthermore, alarm systems have been used in which a plurality of such alarm devices are provided, and when an abnormal condition is detected in any one of these alarm devices and the alarm device outputs an alarm, the other alarm devices also output an alarm in a linked manner. A known example of such an alarm device comprises a transmission device for transmitting linkage instructions to an external destination, and a reception device for receiving linkage instructions from an external source, and emitting an alarm upon detecting an abnormal condition or receiving a linkage instruction from an external source (see Japanese Unexamined Patent Application, First Publication No. 2007-213507, for example).

[Second Background Art]

Furthermore, conventionally, household alarm devices (hereafter "alarm devices") which detect abnormal conditions such as fires or gas leaks in a residence and issue an alarm have become prevalent, and in recent years, there is a growing trend towards monitoring for abnormal conditions such as a fire on a room-by-room basis by installing a plurality of alarm devices throughout a single residence (see Japanese Unexamined Patent Application, First Publication No. 2007-094719, for example).

When a plurality of alarm devices are installed in a single residence in this manner, a person who is present in a different room from the room where the abnormal condition occurred may not hear the alarm sound, giving the fire or other problem a chance to spread. Therefore, by connecting each alarm device to the others using wires, when a particular alarm device detects a fire and issues an alarm, the alarm signal is sent from this alarm device to the other alarm devices so that the alarm is emitted simultaneously, thereby realizing a linked alarm system.

However, because providing a wired connection between each alarm requires that wiring be installed, a problem arises in terms of increased costs. This problem can be resolved by employing wireless alarm devices. Furthermore, because the ICs used in modern wireless circuits have very low power consumption, even when operating in a state of constant readiness to receive alarm signals from other alarm devices, battery life that is sufficient from a practical standpoint, for example five years or longer, is assured. Accordingly, an environment that enables the practical use of wireless alarm devices is steadily taking shape.

Incidentally, with wireless alarm devices, because there is no way of knowing when an alarm signal indicating an abnormal condition will be received from one of the other alarm devices, the reception circuit must be in constant readiness to receive an alarm signal. However, because this increases power consumption, reception behavior takes place at a predetermined reception cycle.

FIG. 17 is a timing chart showing the transmission behavior and reception behavior of a conventional wireless alarm device. In FIG. 17, (A) shows the behavior of a transmitting side alarm device, (B) shows the behavior of a receiving side alarm device, and (C) shows the alarm output behavior of the receiving side alarm device.

As shown in (B) in FIG. 17, the alarm device on the receiving side performs intermittent reception behavior in a repeating cycle T112 (=T101+T102) consisting of reception behavior for a duration T101 interposed with a rest time T102. On the other hand, as shown in (A) in FIG. 17, the alarm device on the transmitting side, upon detecting an abnormal condition, transmits a detection signal (alarm signal) indicating the abnormal condition continuously and repeatedly for a duration T104.

The transmission time T104 is set to a time equal to or longer than the intermittent reception cycle T112 (=T101+T102), so that regardless of when transmission is initiated, the reception behavior that spans a time T101 occurs at least once during the transmission time T104, enabling the detection signal from the transmission side alarm device to be reliably received.

As a result of this intermittent reception behavior, there is no need for the reception circuitry to remain in a state of constant readiness, and the power consumption of the reception circuitry can be reduced, thereby guaranteeing battery life exceeding five years in wireless alarm devices.

However, in an alarm device and alarm system according to the first background art described above, in order for the other alarm devices to perform alarm output in a linked manner when an alarm is output from an arbitrary alarm device within the alarm system, the alarm signal transmitted from the alarm device which detected the occurrence of the abnormal condition must be received by the other alarm devices. Therefore, the reception device of each alarm device is operated on a constant or intermittent basis so that the alarm device can receive the alarm signals transmitted from the other alarm devices.

In particular, in an alarm device driven by an internal power source such as a battery, to reduce power consumption, the reception device needs to be operated intemittently, with a large interval provided between each intermittent operation. As a result, in the interval after an alarm signal is transmitted from the alarm device that detected the occurrence of the abnormal condition until the alarm signal is received by the other alarm devices, in some cases a length of time equivalent to the time interval between intermittent operations is required. Accordingly, a problem occurs in that a lack of synchronization occurs between the timing at which the alarm signal is output from the alarm device that detected the occurrence of the abnormal condition, and the timing at which an alarm is output by the other alarm devices that received the alarm signal transmitted from this alarm device. For example, when a user runs an operation test after installing the alarm devices, the delay between output of the alarm signal by the alarm device being tested and alarm output by the other alarm devices may be misconstrued as a fault in the alarm device.

Accordingly, an alarm device and alarm system is desired which suppresses gaps in alarm output timing between the alarm device that transmits the alarm signal and the alarm devices that receive the alarm signal.

Furthermore, in the wireless alarm device that performs intermittent reception behavior described in the second background art, in the same manner, depending on the timing with which the alarm device on the transmission side initiates signal transmission, the timing with which the alarm device on the receiving side receives the signal and starts linked alarm output can present significant delays relative to initiation of alarm output by the transmission side alarm device.

FIG. 18 is a timing chart showing the transmission timing which produces the greatest delay in terms of initiating alarm output on the receiving side. In FIG. 18, (A) shows the behavior of the transmission side alarm device, (B) shows the behavior of the reception side alarm device, and (C) shows the alarm output behavior of the reception side alarm device. As shown in FIG. 18, if the alarm device on the transmission side initiates signal transmission immediately after the alarm device on the receiving side performs reception behavior at a time T101, the next reception behavior takes place after a time T102 has elapsed. Accordingly, the delay time T100*d* from alarm initiation on the transmission side until linked alarm initiation on the reception side is long, causing a problem in that linked alarm output is delayed.

For example, the rest time T102 in the intermittent reception is 10 to 20 seconds or thereabouts, and if, to enhance reliability, a system whereby an alarm is emitted after an alarm signal is received three times is adopted, the delay time T100*d* from when alarm output is initiated on the transmission side until linked alarm output is initiated on the reception side is 30 to 60 seconds or thereabouts, significantly delaying linked alarm output.

Accordingly, it is desired to provide an alarm device which suppresses alarm delays associated with intermittent reception on the reception side, and achieves prompt linked alarm output.

In consideration of the circumstances disclosed in the first and second background art, an object of the present invention is to provide an alarm device and alarm system which can resolve the problems associated with a lack of synchronization in the transmission and reception timing of the alarm signal between alarm devices.

SUMMARY OF THE INVENTION

To resolve the above problems and achieve the objectives, the present invention employs the following measure:

(1) That is, an alarm device of the present invention comprises: a detection device which detects an occurrence of an abnormal condition within a monitoring area; a transmission device which transmits an alarm signal when the detection device detects the abnormal condition; and an output device which, after the transmission device has transmitted the alarm signal, outputs an alarm after a lapse of a predetermined time after the transmission.

(2) In the alarm device according to (1) above, the output device may be configured so as to output the alarm at a first volume at substantially the same time as transmission of the alarm signal by the transmission device, and then change the volume of the alarm from the first volume to a different second volume when the predetermined time has elapsed since transmission of the alarm signal.

(3) In the alarm device according to (1) above, the detection device may further comprise a display device which displays an alarm when the detection device detects the abnormal condition.

(4) Furthermore, an alarm system of the present invention detects an abnormal condition within a monitoring area and outputs an alarm, and comprises: the alarm device according to (1) above; and a reception apparatus comprising a reception section which receives the alarm signal, and an output section which when the reception section receives the alarm signal, outputs the alarm at substantially the same time as reception of the alarm signal.

(5) In the alarm system according to (4) above, the predetermined time may be set so as to be equivalent to the time taken from transmission of the alarm signal by the transmission device to reception of the alarm signal by the reception section.

(6) In the alarm system according to (4) above, a configuration may be adopted in which the alarm device and the reception apparatus form an integral construction; and a plurality of such integrally constructed alarm devices and reception apparatuses are provided.

(7) Another alarm device of the present invention comprises: a reception circuit section which receives event signals from other alarm devices by performing intermittent reception behavior at a predetermined reception cycle; a transmission circuit section which transmits event signals to the other alarm devices for a transmission time whose duration is equal to or longer than the predetermined reception cycle; a sensor section which detects an abnormal condition; an alert section which outputs an alarm; an abnormal condition monitoring section which upon receiving an abnormal condition detection signal from the sensor section, outputs an abnormal condition alarm itself as a linkage source, and transmits an event signal indicating the abnormal condition to the other alarm devices, and on the other hand, upon receiving an event signal indicating the abnormal condition from one of the other alarm devices, outputs an abnormal condition alarm to the other alarm devices serving as a linkage destination; a preliminary abnormal condition detection section which detects a preliminary abnormal condition when the sensor section detects that the probability of an abnormal condition occurring is greater than a predetermined probability; and a preliminary abnormal condition monitoring section which, when the preliminary abnormal condition is detected, transmits an event signal indicating the preliminary abnormal condition to the other alarm devices, and on the other hand, upon receiving an event signal indicating the preliminary abnormal condition from one of the other alarm devices, either changes the reception cycle of the reception circuit section to a shorter cycle, or changes the reception behavior of the reception circuit section to constant reception.

(8) In the alarm device according to (7) above, the preliminary abnormal condition monitoring section may be provided in the sensor section.

(9) In the alarm device according to (7) above, the preliminary abnormal condition monitoring section, upon detecting the preliminary abnormal condition, may output a preliminary abnormal condition alarm from the alert section.

(10) In the alarm device according to (7) above, the configuration may be such that the preliminary abnormal condition monitoring section, after the event signal indicating the preliminary abnormal condition is transmitted, if the preliminary abnormal condition is no longer detected, transmits an event signal indicating resolution of the preliminary abnormal condition to the other alarm devices, and on the other hand, after either the reception cycle of the reception circuit section is changed to a cycle shorter than the predetermined reception cycle, or the reception behavior of the reception circuit section is changed to constant reception upon receiving an event signal indicating the preliminary abnormal condition from one of the other alarm devices, when the event signal indicating the resolution of the preliminary abnormal condition is received, either restores the reception cycle to the predetermined cycle, or restores the reception behavior of the reception circuit section from the constant reception to the original intermittent reception.

(11) In the alarm device according to (7) above, the configuration may be such that the preliminary abnormal condition monitoring section, when a predetermined time has elapsed since receiving the event signal indicating the preliminary abnormal condition from one of the other alarm devices and either changing the reception cycle of the reception circuit section to a shorter cycle than the predetermined reception cycle, or changing the reception behavior of the reception circuit section to constant reception, either restores the reception cycle to the predetermined cycle or restores the reception behavior of the reception circuit section from the constant reception to the original intermittent reception.

(12) Yet another alarm device of the present invention comprises: a reception circuit section which receives event signals from other alarm devices by performing intermittent reception behavior at a predetermined reception cycle; a transmission circuit section which transmits event signals to the other alarm devices for a transmission time equal to or longer than the predetermined reception cycle; a sensor section which detects an abnormal condition; an alert section which outputs an alarm; an abnormal condition monitoring section which upon receiving an abnormal condition detection signal from the sensor section, outputs an abnormal condition alarm itself as a linkage source, and transmits an event signal indicating the abnormal condition to the other alarm devices, and on the other hand, upon receiving an event signal indicating the abnormal condition from one of the other alarm devices, outputs an abnormal condition alarm to the other alarm devices serving as a linkage destination; and a reception cycle control section which, by a predetermined setting operation, changes a reception cycle of the reception circuit section to a shorter cycle than the predetermined cycle.

According to the alarm device disclosed in (1) above, an alarm device that detects an abnormal condition, after transmitting an alarm signal, outputs an alarm by means of an output device after a predetermined time has elapsed. As a result, the timing of alarm output in an alarm device that detects an abnormal condition, and the timing of alarm output in the other alarm devices and the like which receive the alarm signal from this alarm device, can be made substantially concurrent.

In the case of (2) above, the output device outputs an alarm at a first volume at substantially the same time as the alarm signal is transmitted. As a result, when an alarm device detects an abnormal condition, whether or not this alarm device is operating correctly can be immediately ascertained based on an alarm output at a first volume which is lower than normal volume, for example. Furthermore, because when a predetermined time has elapsed since transmission of the alarm signal the volume of alarm output is increased to a second volume, that is, a normal output volume, the timing of alarm output at the second volume in the alarm device that detected the abnormal condition, and the timing of alarm output in the other alarm devices and the like which receive the alarm signal from this alarm device can be made substantially concurrent.

In the case of (3) above, because the alarm device performs alarm display by means of a display device when an abnormal condition is detected, whether or not this alarm device is operating correctly can be easily ascertained.

In the alarm system disclosed in (4) above, an alarm device that detects an abnormal condition outputs an alarm by means of an output device when a predetermined time has elapsed since the alarm signal was transmitted. As a result, the timing of the alarm output in the alarm device that detected the abnormal condition, and the timing of alarm output in the reception apparatus that received the alarm signal from this alarm device can be made substantially concurrent.

In the case of (5) above, in the alarm device that detected the abnormal condition, because the predetermined time from transmission of the alarm signal until alarm output by the output device is the time required for the alarm signal transmitted by the transmission device to be received by the reception device, the timing of alarm output can be made substantially concurrent between the alarm device that transmits the alarm signal and the other alarm devices that receive the alarm signal.

In the case of (6) above, because the alarm system comprises a plurality of alarm devices having transmission devices and reception devices, an abnormal condition can be detected by any alarm device, with alarm output also being performed by the other alarm devices.

Furthermore, according to the alarm device disclosed in (7) above, when an event signal indicating a preliminary abnormal condition is received from one of the other alarm devices, because the preliminary abnormal condition can be expected to lead to an occurrence of the underlying abnormal condition, at this stage, the intermittent reception cycle is reduced to a shorter cycle. In this state, when an event signal indicating an abnormal condition is received, regardless of the timing with which transmission is initiated in the transmission side alarm device, the maximum delay time from alarm initiation in the transmission side alarm device to alarm initiation in the reception side alarm device is kept to within the shortened intermittent reception cycle. Accordingly, delays in linked alarm output can be kept to a minimum.

Furthermore, upon receiving an event signal for a preliminary abnormal condition, when the intermittent reception cycle is changed to a shorter cycle, the consumption current of the reception circuit section increases causing reduced battery life. However, by notifying the reception side when the preliminary abnormal condition is resolved on the transmission side, or by returning the shortened intermittent reception cycle to the original longer cycle when a predetermined time has elapsed since receiving the event signal indicating the abnormal condition, the increase in power consumption can be kept to a minimum, and a reduction in battery life can be prevented.

Moreover, when an event signal indicating a preliminary abnormal condition is received from one of the other alarm devices, even if intermittent reception has been changed to constant reception, when an event signal indicating an abnormal condition is received in this state, regardless of the timing with which transmission is initiated on the transmission side alarm device, delays in linked alarm output can be substantially eliminated. Furthermore, when intermittent reception is changed to constant reception upon receiving an event signal for a preliminary abnormal condition, the power consumption of the reception circuit section increases leading to reduced battery life. However, by notifying the reception side when the preliminary abnormal condition is resolved on the transmission side, or by returning constant reception to the original intermittent reception when a predetermined time has elapsed since receiving the event signal indicating the abnormal condition, the increase in power consumption can be kept to a minimum, and a reduction in battery life can be prevented.

Furthermore, according to the alarm device disclosed in (12) above, for example by a user operating a predetermined switch when starting use of the alarm device, the intermittent reception cycle is changed from the initial reception cycle to a shorter reception cycle, and when an event signal indicating an abnormal condition is received, regardless of the timing with which transmission is initiated in the transmission side alarm device, the maximum delay time from alarm initiation in the transmission side alarm device to alarm initiation in the reception side alarm device is kept within the shortened intermittent reception cycle, thus keeping the delay in linked alarm output to a minimum.

In other words, although by default this alarm device uses an intermittent reception cycle which guarantees sufficiently long battery life, some users may prefer a mode of use which, rather than securing battery life, keeps delays in linked alarm output to the smallest possible. In this manner, the user can apply his or her judgment according to the mode of use and change the intermittent reception cycle to a shorter cycle, thereby accommodating the needs of users who wish to minimize delays in linked alarm output.

DETAILED DESCRIPTION OF THE INVENTION

Figure 1:
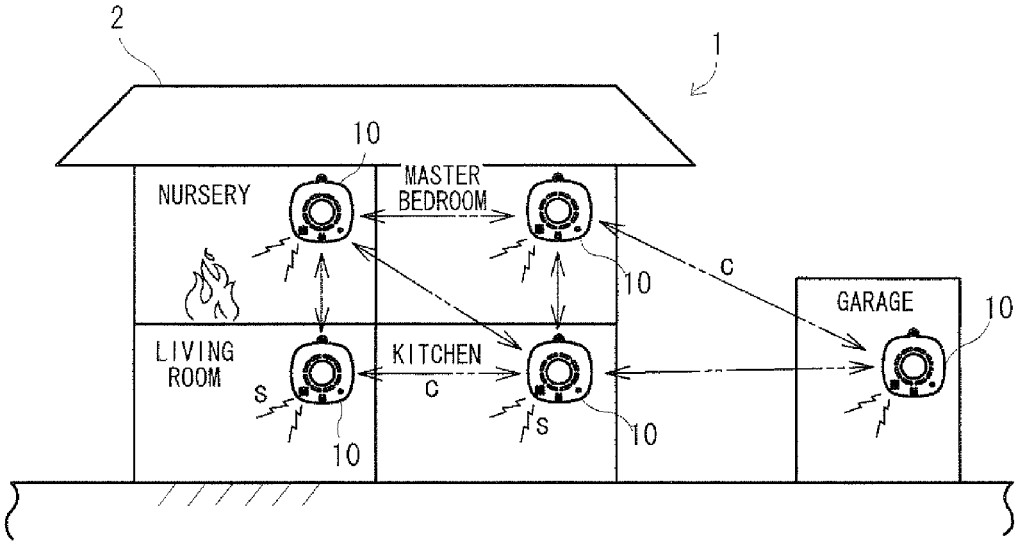
FIG. 1 is a system diagram showing an overview of an alarm system of the present invention.

A first embodiment and second embodiment of an alarm device and alarm system of the present invention are described in detail below with reference to the appended drawings.

First, [I] the fundamental concepts of the first and second embodiments are described, then [II] the specific details of each embodiment are described, and finally [III] modified examples of these embodiments are described. However, the various embodiments shall not be construed as limiting the invention.

[I] Fundamental Concepts Common to the First Embodiment and Second Embodiment

First, the fundamental concepts that are common to both embodiments are described. The object of the alarm device and alarm system according to both embodiments is to detect an occurrence of an abnormal condition in a monitoring area and output an alarm. The configuration of the alarm device and alarm system according to the embodiments can be changed arbitrarily. For example, an alarm device which transmits an alarm signal and a reception apparatus which receives this alarm signal and outputs an alarm can be provided as separate units, or a construction may be employed in which the two are integrated with each other. In the embodiments below, an example is given in which the alarm device and the reception apparatus are integrated with each other.

The installation location and application of the alarm device and alarm system according to both embodiments is arbitrary; for example, the present invention may be installed in the rooms of a residence such as a kitchen, stairway, bedrooms, and living room, or in a large scale building such as an underground complex, high rise building, or factory. Furthermore, the present invention can also be applied to alarm devices such as fire alarms and monitoring sensors, and to alarm systems that include a plurality of alarm devices. When applied to an alarm system, the means of communication between the plurality of alarm devices in the alarm system is arbitrary. For example wireless, wired, and optical communication can be used.

One characteristic of the alarm device and alarm system according to the embodiments, in general terms, is that the timing of alarm output in an alarm device that detects an abnormal condition is delayed until a predetermined time has elapsed after transmission of the alarm signal. As a result, the timing of alarm output in the alarm device that detects the abnormal condition and the timing of alarm output in the other alarm devices that receive the alarm signal from this alarm device can be made substantially concurrent.

[II] Specific Details of the First Embodiment and the Second Embodiment

Next, the specific details of the embodiments are described. Although as mentioned above the installation location and application of the alarm devices and alarm system in the embodiments is arbitrary, the descriptions below use an example of application to a wireless residential alarm device (hereafter "alarm device") which is installed in a residence and communicates using wireless signals.

[First Embodiment]

First, a first embodiment is described. In this embodiment, in an alarm device that detects an abnormal condition, the timing of alarm output is delayed.

(Alarm System Overview)

First, an alarm system is described in general terms. FIG. 1 is a system diagram showing an overview of an alarm system. In FIG. 1, the letter c indicates communication, and the letter s indicates an alarm (audible alarm). In the present embodiment, an alarm device 10 is installed in each room of a residence 2. When a fire or the like occurs in any of these rooms, and is detected by the alarm device 10 in that room, this alarm device 10 transmits a wireless signal containing details of the alarm to the alarm devices 10 in the other rooms. The alarm devices 10 in the other rooms, based on the content of the received wireless signal, emit an alarm. As a result, an alarm is also emitted by the alarm devices 10 in rooms where no fire or the like has occurred, and the residents of the residence 2 are able to take appropriate measures.

(Construction of Alarm Device 10)

Figure 2:
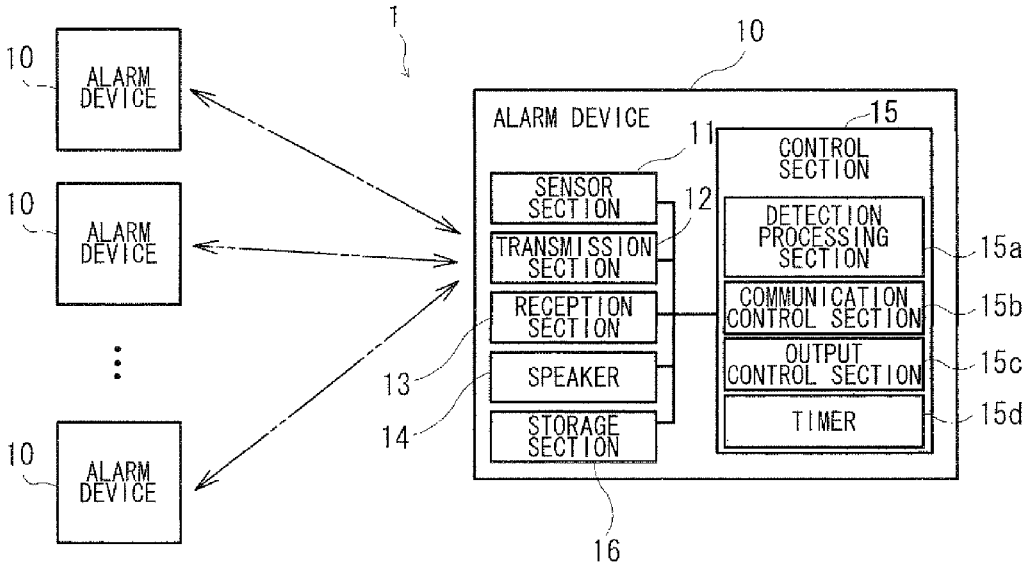
FIG. 2 is a block diagram showing an overview of the construction of an alarm device in this alarm system.

Next, the construction of the alarm device 10 is described. FIG. 2 is a block diagram showing an overview of the construction of the alarm device 10. As described above, the alarm device 10 detects an abnormal condition such as a fire and performs transmission and reception of alarm signals and outputs an alarm, and corresponds to the alarm device and reception apparatus in the claims. As shown in FIG. 2, the alarm device 10 comprises a sensor section 11, a transmission section 12, a reception section 13, a speaker 14, a control section 15, and a storage section 16.

(Construction of Alarm Device 10: Sensor Section 11)

The sensor section 11, within the monitoring area where the alarm device 10 is installed, detects a detection target such as a fire or gas leak, and corresponds to the detection device in the claims. The detection targets and principles for detecting those targets are arbitrary. For example, the smoke or heat produced by a fire may be the detection target, and to detect these targets, electronic devices such as infrared LEDs, photodiodes, and thermistors can be used.

(Construction of Alarm Device 10: Transmission Section 12 and Reception Section 13)

The transmission section 12 transmits alarm signals to other alarm devices 10, and corresponds to the transmission device in the claims. The reception section 13 receives alarm signals transmitted from the transmission sections 12 of the other alarm devices 10, and corresponds to the reception device in the claims. The specific configuration of the transmission section 12 and the reception section 13 is arbitrary. However, because in the present embodiment an assumption is made that communication occurs wirelessly, the transmission section 12 can be a known type of wireless transmission device, and the reception section 13 can be a known type of antenna.

(Construction of Alarm Device 10: Speaker 14)

The speaker 14 outputs an audible alarm subject to control from an output control section 15*c* described later, and corresponds to the output device in the claims. For the speaker 14, the specific configuration for audio output is arbitrary, and a known type of speaker or buzzer or the like may be used.

(Construction of Alarm Device 10: Control Section 15)

The control section 15 performs various control operations in the alarm device 10, and comprises a detection processing section 15*a*, a communication control section 15*b*, an output control section 15*c*, and a timer 15*d*. The detection processing section 15*a* is a processing device which controls operation of the sensor section 11 and processes the detection signal. The communication control section 15*b* is a control device which controls the transmission section 12 and the reception section 13 and performs signal processing. The output control section 15*c* controls alarm output by means of the speaker 14, and corresponds to the output device in the claims. The timer 15*d* is the timing device referenced by the communication control section 15*b* when controlling the operation of the transmission section 12. Details of the processing executed by the control section 15 are described later. The specific construction of the control section 15 is arbitrary, but can incorporate, for example, a control program such as an OS (Operating system), integrated programs that define various procedures and the like, internal memory for storing the necessary data, and a CPU (Central Processing Unit) which executes the programs.

(Construction of Alarm Device 10: Storage Section 16)

The storage section 16 stores the data required for various processing performed in the alarm device 10, and stores, for example, the time to wait from alarm signal transmission by the transmission section 12 until audible alarm output by the speaker 14. This wait time corresponds to the predetermined time in the claims. The specifics of the wait time are arbitrary, but, for example, to ensure substantially concurrent alarm output timing between the alarm device 10 which transmits an alarm signal and the alarm devices 10 which receive the alarm signal, a time equivalent to the interval used by the communication control section 15*b* for intermittent reception by the reception section 13 is preferably used as the wait time. The specific configuration of the storage section 16 is arbitrary. For example, a non-volatile storage device such as memory IC can be used.

(Timing of Alarm Output by the Speaker 14)

Figure 3:
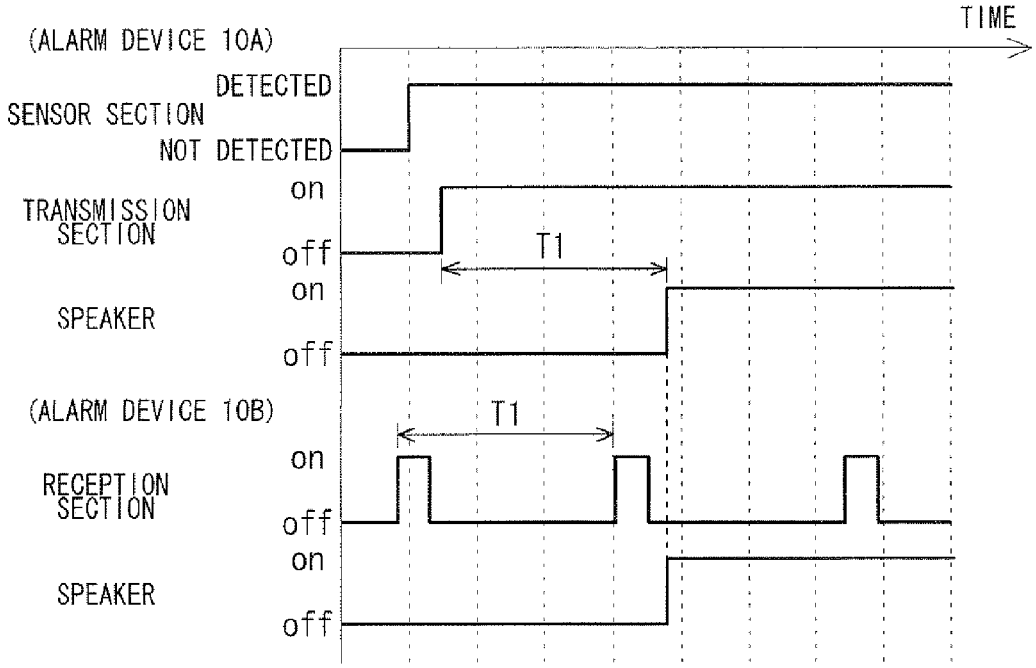
FIG. 3 is a timing chart showing the activation timing of a sensor 11, transmission section 12, and speaker 14, of an alarm device 10A, and a reception section 13 and speaker 14 of an alarm device 10B.

Next, the timing of alarm output by the speaker 14 of the alarm device 10 is described. Here, the description uses an example in which two alarm devices 10A, 10B are installed in a residence 2 or the like, and an abnormal condition is detected by the alarm device 10A. FIG. 3 is a timing chart showing the activation timing of the sensor section 11, transmission section 12, and speaker 14 of the alarm device 10A, and the reception section 13 and the speaker 14 of the alarm device 10B. As shown in FIG. 3, when the sensor section 11 of the alarm device 10A detects an abnormal condition, the transmission section 12 is activated and an alarm signal is transmitted. On the other hand, in the alarm device 10B, the reception section 13 is operated intermittently at a constant interval (T1 in FIG. 3), and when the alarm signal is received from the alarm device 10A, an alarm is output by the speaker 14. Thus, in the alarm device 10A, by using the operation interval T1 of the reception section 13 of the alarm device 10B as the wait time from transmission of the alarm signal to alarm output by the speaker 14, as shown in FIG. 3, the activation timing of the speaker 14 in the alarm device 10A is made substantially concurrent with the activation timing of the speaker 14 in the alarm device 10B.

(Processing Behavior at Abnormal Condition Detection)

Figure 4:
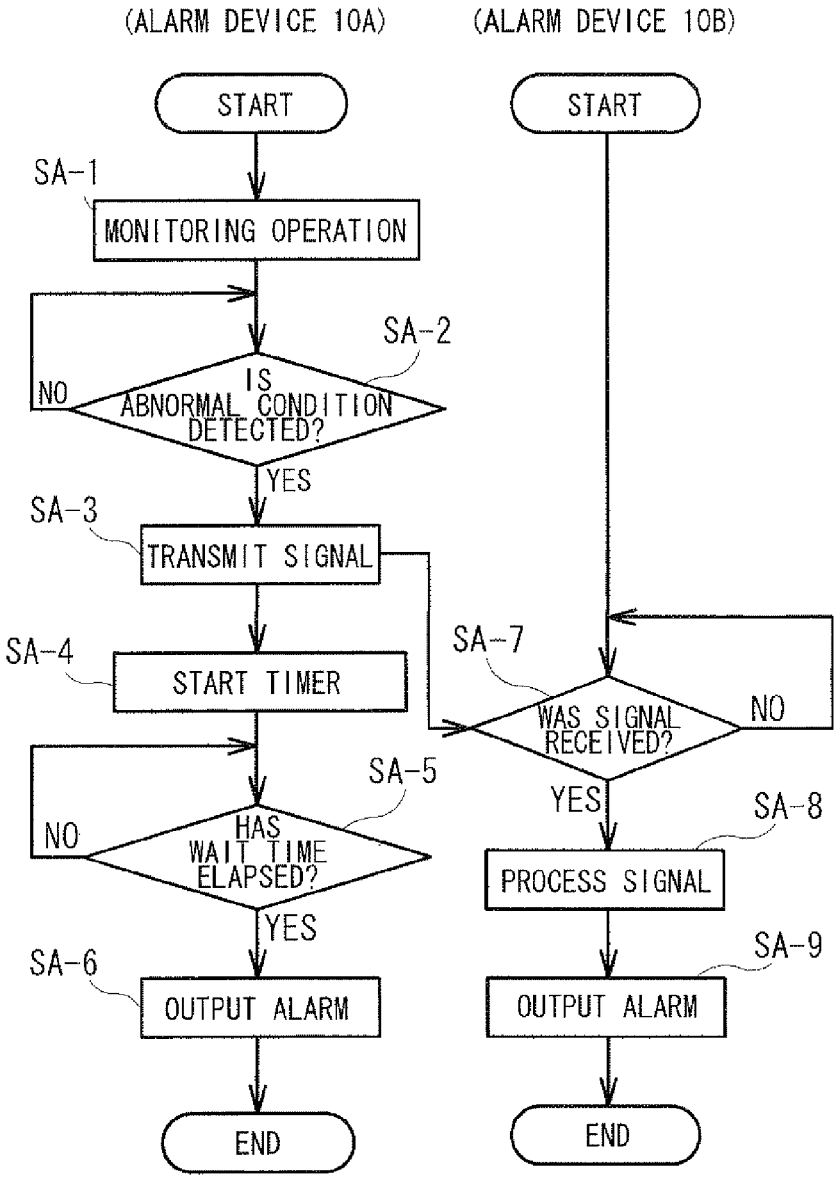
FIG. 4 is a flowchart showing the flow of processing executed by a control section 15 of the alarm devices 10A and 10B.

Next, for a case where any of the alarm devices 10 associated with an alarm system 1 detect an abnormal condition such as fire, the processing behavior of each alarm device 10 is described. FIG. 4 is a flowchart showing the flow of processing executed by the control section 15 of the alarm device 10. Here, the description uses an example of a case where two alarm devices 10A, 10B are installed in a residence 2 or the like, and both the alarm devices 10A, 10B have entered monitoring status by way of a predetermined input operation. The alarm devices 10A, 10B are associated with the same alarm system 1.

When monitoring status begins as a result of the predetermined input operation, the detection processing sections 15*a* of the alarm devices 10A, 10B execute monitoring of the monitoring area by means of the sensor section 11 (step SA-1). If the sensor section 11 of the alarm device 10A detects a fire or the like (Yes in step SA-2), based on the detection signal output from this sensor section 11 and processed by the detection processing section 15*a*, the communication control section 15*b* of the alarm device 10A transmits an alarm signal by means of the transmission section 12 (step SA-3), and also starts the timer 15*d* (step SA-4). Then, the output control section 15*c* of the alarm device 10A references the timer 15*d* and the storage section 16, and determines whether or not the time elapsed since transmission of the alarm signal as measured by the timer 15*d* has reached the wait time recorded in the storage section 16 (step SA-5). As a result, if the wait time is not reached (No in step SA-5), then the waiting state is maintained, while if the wait time is reached (Yes in step SA-5), then an alarm is output by the speaker 14 (step SA-6).

On the other hand, the communication control section 15*b* of the alarm device 10B operates the reception section 13 intermittently at a constant interval, thereby waiting for signal transmission from another alarm device 10 (step SA-7). When a signal is received by the reception section 13 (Yes in step SA-7), the communication control section 15*b* processes the received signal, and based on the result (for example whether the received signal is an alarm signal or a fault signal), inputs predetermined data into the output control section 15*c* (step SA-8). The output control section 15*c*, based on the input data, outputs an alarm by means of the speaker 14 (step SA-9).

(Effects of the First Embodiment)

According to the embodiment described above, an alarm device 10 that detects an abnormal condition, after transmitting an alarm signal to the other alarm devices 10, outputs an alarm by means of a speaker 14 after a predetermined wait time has elapsed. As a result, the timing of alarm output in the alarm device 10 that detects the abnormal condition, and the timing of alarm output in the other alarm devices 10 that receive the alarm signal from this alarm device 10, can be made substantially concurrent.

Furthermore, in the alarm device 10 that detects the abnormal condition, the wait time from transmission of the alarm signal until alarm output by the speaker 14 is set to a time equivalent to the operation interval for when the communication control section 15*b* in the reception side alarm device 10 intermittently activates the reception section 13. Therefore, in the alarm device 10 that transmits the alarm signal and the alarm devices 10 that receive the alarm signal, the timing of alarm output can be made substantially concurrent.

Moreover, because the alarm system 1 comprises a plurality of alarm device 10 having a transmission section 12 and a reception section 13, an abnormal condition can be detected by any of the alarm devices 10, and alarm output can also be performed by the other alarm devices 10.

[Second Embodiment]

Next, a second embodiment is described. In this embodiment, the volume of alarm output is varied.

The construction of the present embodiment, except where specifically mentioned, is substantially the same as the construction of the first embodiment, and thus elements which have substantially the same configuration as in the first embodiment are assigned the same reference numerals and/or names as necessary, and description thereof is omitted.

(Construction of Alarm Device 10: Display Section 17)

Figure 5:
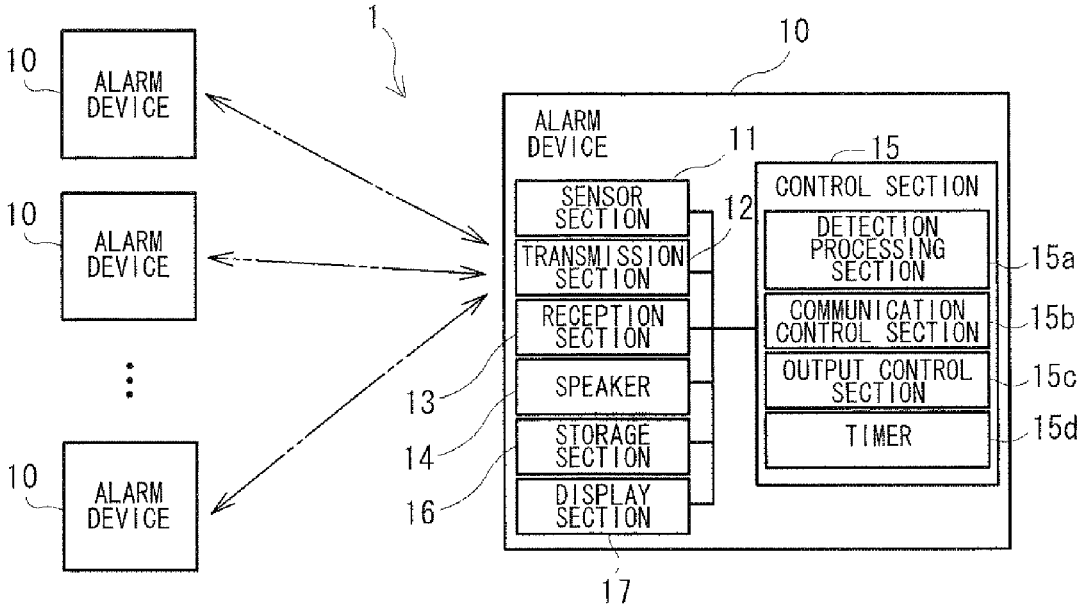
FIG. 5 is a block diagram showing an overview of the construction of an alarm device 10.

FIG. 5 is a block diagram showing an overview of the construction of an alarm device 10 according to the second embodiment. As shown in FIG. 5, the alarm device 10 comprises a display section 17. The display section 17 performs alarm display based on control input from the output control section 15*c*, and corresponds to the display device in the claims. The specific construction of the display section 17 is arbitrary. For example, luminescent display using one or more LEDs, or symbol or character display using an LCD screen, may be performed.

(Construction of Alarm Device 10: Output Control Section 15*c*)

The output control section 15*c* according to the present embodiment, in addition to controlling the timing of alarm output by the speaker 14, also controls the volume of alarm output by this speaker 14. The volume of the audible alarm output from the speaker 14 is arbitrary. For example, an alarm can be output at a second volume during normal alarm output, and at a first volume which is smaller than this second volume. Details of the control performed by the output control section 15*c* are described later.

(Processing Behavior During Abnormal Condition Detection)

Figure 6:
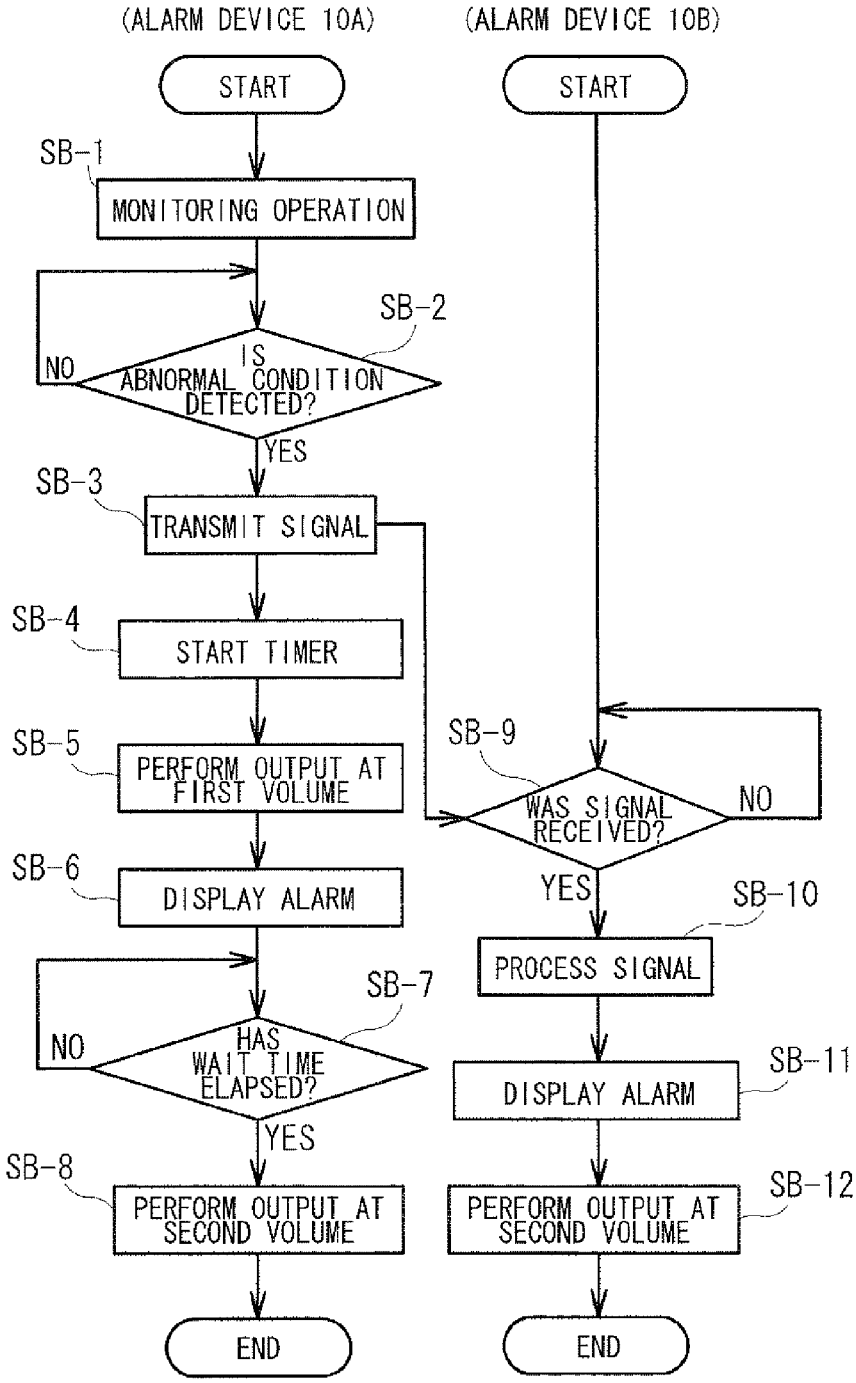
FIG. 6 is a flowchart showing the flow of processing executed by a control section 15 of the alarm devices 10A and 10B.

Next, the processing behavior of each alarm device 10 is described for a case where one of the alarm devices 10 associated with the alarm system 1 detects an abnormal condition such as a fire. FIG. 6 is a flowchart showing the processing executed by the control section 15 of the alarm device 10. Here, in the same manner as the first embodiment above, the description uses an example of a case where two alarm devices 10A, 10B associated with the same alarm system 1 are installed in a residence 2 or the like, and both the alarm devices 10A, 10B have entered monitoring status by way of a predetermined input operation.

First, because the processing from step SB-1 to step SB-4 is the same as the flow from step SA-1 to SA-4 in the first embodiment, description thereof is omitted.

Together with the start of the timer 15*d* in step SB-4, the output control section 15*c* of the alarm device 10A outputs an alarm at a first volume by means of the speaker 14 (step SB-5), and performs alarm display by means of the display section 17 (SB-6). Then, the output control section 15*c* of the alarm device 10A references the timer 15*d* and the storage section 16, and determines whether or not the time elapsed since transmission of the alarm signal as measured by the timer 15*d* has reached the wait time stored in the storage section 16 (step SB-7). As a result, if the wait time is not reached (No in step SB-7) then alarm output by the speaker 14 remains at the first volume, while if the wait time is reached (Yes in step SB-7), the volume of alarm output is increased to a second volume (step SB-8).

On the other hand, the communication control section 15*b* of the alarm device 10B operates the reception section 13 intermittently at a constant interval, thereby waiting for signal transmission from another alarm device 10 (step SB-9). When a signal is received by the reception section 13 (Yes in step SB-9), the communication control section 15*b* processes the received signal, and based on the result (for example whether the received signal is an alarm signal or a fault signal), inputs predetermined data into the output control section 15*c* (step SB-10). The output control section 15*c,* based on the input data, performs alarm display by means of the display section 17 (step SB-11), and outputs an alarm at a second volume by means of the speaker 14 (step SB-12).

(Effects of the Second Embodiment)

According to the embodiment described above, the output control section 15*c*, at substantially the same time as transmission of the alarm signal, outputs an alarm at a first volume by means of the speaker 14. Therefore, when an alarm device 10 detects an abnormal condition, whether or not this alarm device 10 is operating normally can be ascertained immediately by way of an alarm output at a first volume which is smaller than the normal volume. Furthermore, because the volume of alarm output is increased to a second volume, which is the volume of normal alarm output, after a predetermined wait time has elapsed since transmitting the alarm signal to the other alarm devices 10, the timing of alarm output at the second volume in the alarm device 10 that detects the abnormal condition, and the timing of alarm output in the other alarm devices 10 that receive the alarm signal from this alarm device 10, can be made substantially concurrent.

Furthermore, when the alarm device 10 detects an abnormal condition, because the output control section 15*c* performs alarm display by means of the display section 17, whether or not this alarm device 10 is operating correctly can be easily ascertained.

[III] Modified Examples of the First and Second Embodiments

Embodiments of the present invention have been described above. However various alterations and improvements can be made to the specific construction and methods used in the present invention, provided that they do not depart from the scope of the appended claims. Such modified examples are described below.

(Regarding the Problems to be Solved, and Effects of the Invention)

First, the problems to be solved by the invention and the effects of the invention are not to be interpreted as limited to the content given above. The present invention may solve problems not disclosed above, and demonstrate effects not disclosed above. Furthermore, the present invention may solve the disclosed problems only in part, or demonstrate the stated effects only in part.

(Regarding the Construction of the Alarm Device and Alarm System)

In the embodiments above, the description has been for the case where a construction was employed in which the alarm device that transmits the alarm signal is integrated with the reception apparatus that receives this alarm signal and outputs an alarm. However the construction may be such that the alarm device and reception apparatus are separate units. For example, the present invention can be applied to an alarm system in which a plurality of alarm devices are connected to a single disaster prevention receiver.

(Regarding the Correlation Between the First Volume and Second Volume)

In the second embodiment, the first volume is quieter than the second volume, but the first volume may instead be louder than the second volume. Alternatively, rather than simply having a different volume for the second volume and first volume, the alarm output during the wait time after alarm signal transmission can be distinguished from the alarm output after the wait time has elapsed by using a different pitch or sound or the like. In this ease, a lack of synchronization between the alarm device that transmits the alarm signal and the alarm devices that receive this alarm signal can be easily ascertained as being due to the time required for the transmission and reception of the alarm signal.

[Third Embodiment]

A third embodiment of the present invention is described in detail below, with reference to the appended drawings.

Figure 7B:
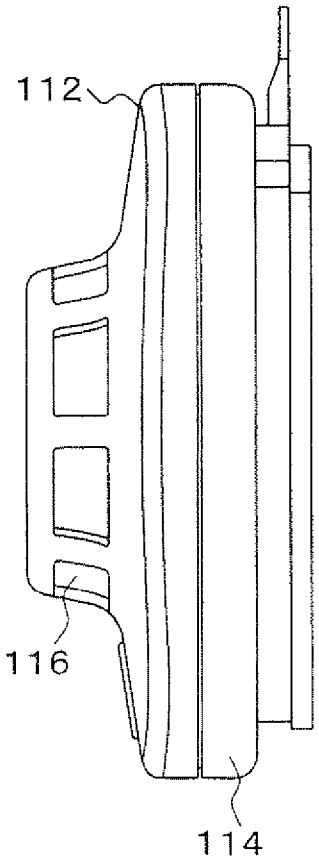
FIG. 7B is a side view of the same alarm device.
Figure 7A:
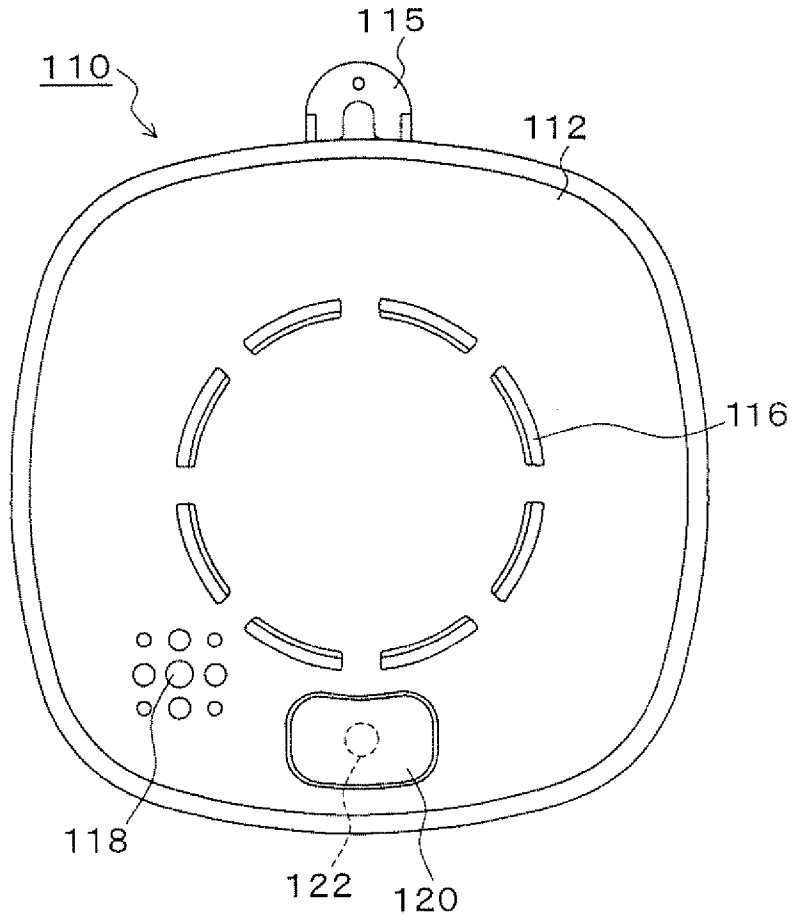
FIG. 7A is a front view of the alarm device of the present invention.

FIG. 7A and FIG. 7B show the outward appearance of a wireless alarm device of the present embodiment, wherein FIG. 7A shows a front view and FIG. 7B shows a side view.

As shown in FIG. 7A and FIG. 7B, an alarm device 110 of the present embodiment comprises a cover 112 and a main unit 114. At the center of the cover 112, a smoke detector section 116, having openings through which smoke can enter formed around the periphery thereof, is disposed, which detects a fire when smoke from the fire reaches a predetermined concentration.

As shown in FIG. 7A, at the lower left side of the smoke detector section 116 of the cover 112, a sound hole 118 is provided. A speaker is housed behind this sound hole 118, such that an audible alarm or voice message can be output through the sound hole 118. Underneath the smoke detector section 116, an alarm stop switch 120 is provided. The alarm stop switch 120 also functions as a test switch.

Inside the alarm stop switch 120, an LED 122 is installed as illustrated by the dashed line, When the LED 122 is lit, the lit status of the LED122 can be recognized from outside through the switch cover of the alarm stop switch 120.

Furthermore, a mounting hook 115 is provided at the top of the back side of the main unit 114, and by screwing a screw (not shown) into a wall of the room where the alarm. device 110 is to be installed, and fitting the mounting hook 115 over this screw, the alarm device 110 can be mounted to the wall surface.

Although with the alarm device 110 shown in FIG. 7A and FIG. 7B, an example of a configuration in which the smoke detector section 116 detects smoke from a fire is used, alarm devices that comprise a thermistor to detect the heat of a fire, or alarm devices that detect gas leaks in addition of fire, are also within the scope of the present invention.

Figure 8:
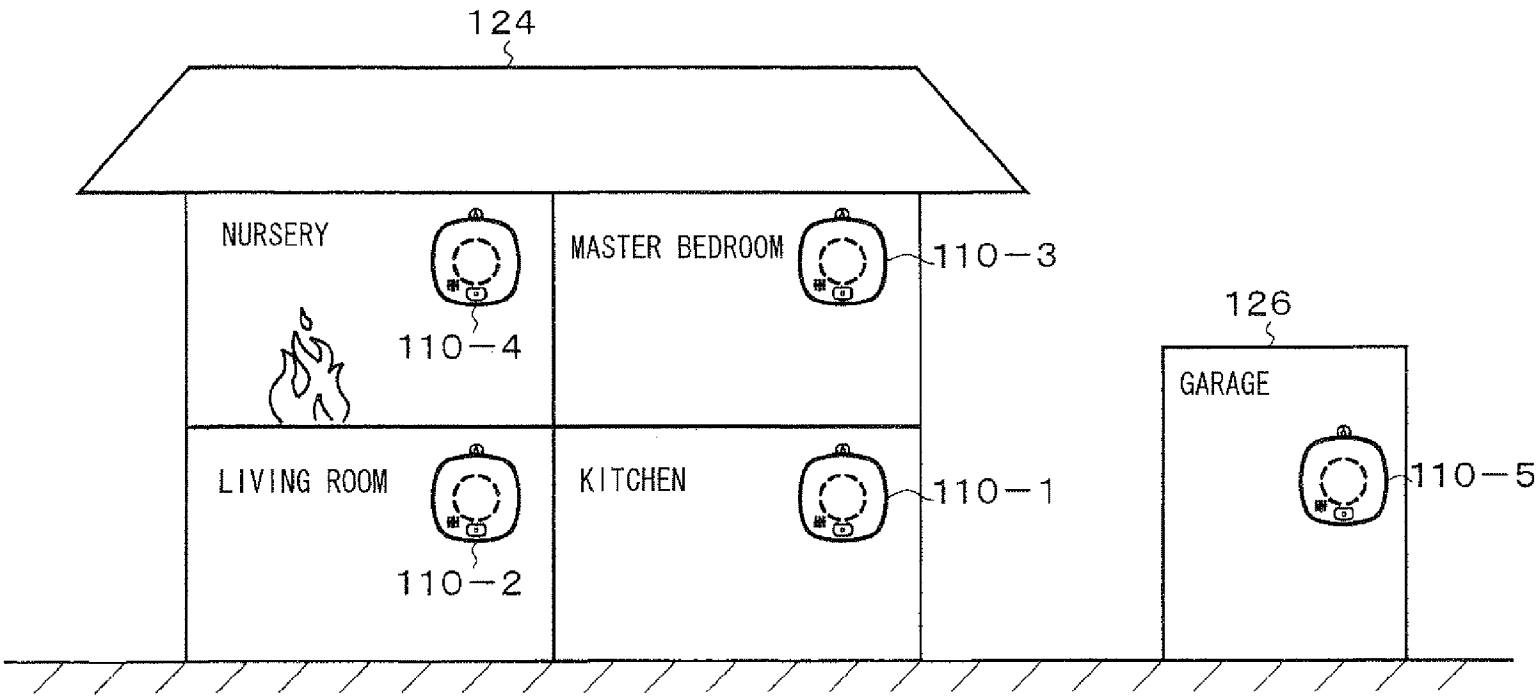
FIG. 8 is an explanatory drawing showing a situation where alarm devices are installed in a residence.

FIG. 8 is an explanatory drawing showing a situation in which alarm devices of the present embodiment are installed in a residence. In the example in FIG. 8, alarm devices 110-1 to 110-4 of the present embodiment are installed in the kitchen, living room, master bedroom, and nursery of a residence 124 respectively, and an alarm device 110-5 is also installed in an external garage 126.

Each of the alarm devices 110-1 to 110-5 comprises functionality for exchanging event signals with each other by wireless transmission and reception, and the five alarm devices 110-1 to 110-5 form a single group to monitor for fires throughout the entire residence 124.

If a fire occurs in the nursery of the residence 124, the alarm device 110-4 detects the fire and initiates a warning process. Hereafter, detecting a fire and starting a warning process is called "alert activation" in an alarm device. When the alarm device 110-4 undergoes alert activation, the alarm device 110-4 functions as the linkage source, and to the other alarm devices 110-1 to 110-3 and 110-5 serving as the linkage destinations, wirelessly transmits an event signal indicating the fire alert. The other alarm devices 110-1 to 110-3 and 110-5, upon receiving the event signal indicating the fire alert from the alarm device 110-4 serving as the linkage source, perform alert behavior as linkage destinations.

As the audible alarm of the alarm device 110-4 serving as the linkage source, for example a siren followed by a voice message "The fire alarm has activated. Please verify." may be output continuously. On the other hand, the linkage destination alarm devices 110-1 to 110-3 and 110-5 continuously output a siren followed by a voice message "The fire alarm in another room has activated. Please verify." In a state where the alarm devices 110-1 to 110-5 are outputting an audible alarm, if the alarm stop switch 120 provided on the alarm device 110 shown in FIG. 7A is operated, processing to stop the audible alarm takes place.

Furthermore, the alarm devices 110-1 to 110-5 comprise failure monitoring functionality, and when a failure is detected, a warning sound, for example a beep, is output intermittently at predetermined intervals to report that a failure has occurred. Moreover, the failure source alarm device where the failure is detected wirelessly transmits an event signal indicating the failure to the other alarm devices, and in the other alarm devices, the same failure warning is output. As a result, when a failure is detected in any of the alarm devices, a failure warning is output from all of the alarm devices that constitute the linked alarm group.

The failure warning output from the alarm devices can be stopped by operating the alarm stop switch 120. In the present embodiment, of the failures detected and reported by an alarm, device, a low battery warning which detects and warns of a reduction in the battery voltage in the local alarm device is the most common, and others include warnings of pertinent failures such as the failure of a sensor in a smoke detector section or the like.

In addition, the alarm devices 110-1 to 110-5 of the present embodiment, upon detecting a preliminary abnormal condition when the probability of an occurrence of the abnormal condition undergoing detection is high, transmit an event signal to the other alarm devices which shortens the intermittent reception behavior in the other alarm devices and suppresses delays in the reception of subsequent event signals associated with the abnormal condition underlying the preliminary abnormal condition, thus suppressing delays in alarm initiation on the receiving side relative to alarm initiation on the transmission side.

Figure 9:
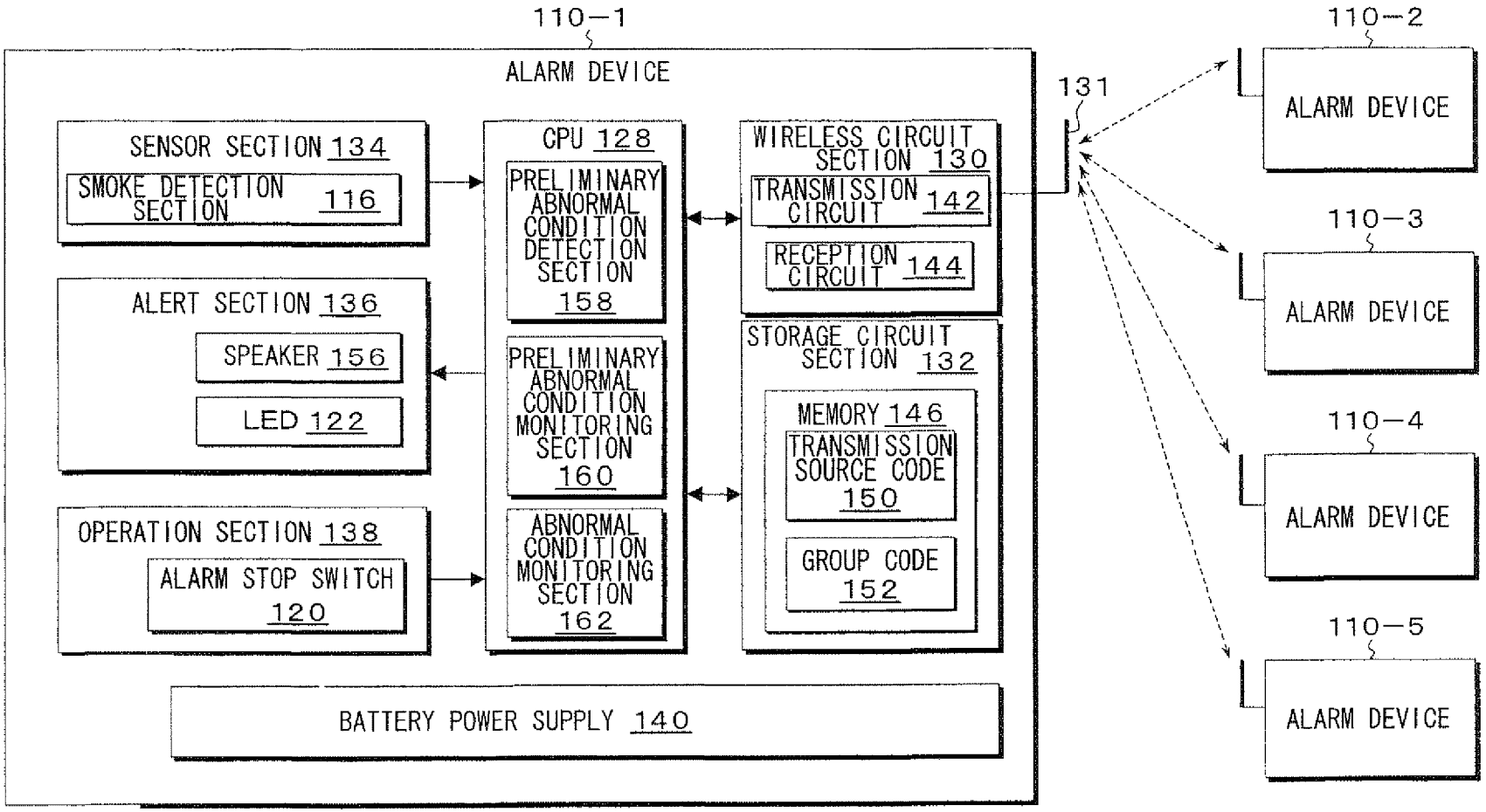
FIG. 9 is a block diagram showing an overview of the construction of the same alarm device.

FIG. 9 is a block diagram showing the alarm device of the present embodiment. Of the five alarm devices 110-1 to 110-5 shown in FIG. 8, FIG. 9 shows in detail the circuit structure for the alarm device 110-1.

The alarm device 110-1 comprises a CPU 128. Furthermore, the alarm device comprises a wireless circuit section 130 comprising an antenna 131, a storage circuit section 132, a sensor section 134, an alert section 136, an operation section 138, and a battery power supply 140 which are associated with the CPU 128.

In the wireless circuit section 130, a transmission circuit 142 and a reception circuit 144 are provided, enabling the wireless transmission and reception of event signals to and from the other alarm devices 110-2 to 110-5. As the wireless circuit section 130, within Japan for instance, preferably a configuration is employed that conforms with STD-30 (a standard for wireless communication equipment in wireless stations for low power security systems) or STD-T67 (a standard for telemeters, telecontrol, and data transmission radio equipment for specified low power radio stations) which are known standards for specified low power radio stations in the 400 MHz band.

Naturally, as the wireless circuit section 130, in locations other than Japan, preferably a configuration is employed that conforms to the standards for allocated wireless base stations in that region.

The reception circuit 144 performs reception on an intermittent basis. The intermittent reception behavior of the reception circuit 144 comprises, for example, a reception period of T101=5 milliseconds followed by a waiting period of T102=10 seconds, yielding intermittent reception in a cycle of T112 (=T101+T102). To accommodate this intermittent reception, the transmission circuit 142 transmits an event signal continuously for a duration of T104 which equals or exceeds the intermittent reception cycle T112 (=T101+T102).

In addition, the reception circuit 144 of the present embodiment can change the initial intermittent reception cycle T112 associated with normal operation to a shorter intermittent reception cycle T113 in response to an instruction from the CPU 128.

In the storage circuit section 132, a memory 146 is provided. In the memory 146 are stored a transmission source code 150 which serves as an ID for identifying the alarm device, and a group code 152 for forming a group of a plurality of alarm devices as shown in FIG. 9 which perform linked alarm output. As the transmission source code 150, based on the estimated number of alarm devices to be supplied throughout the country, a 26 bit code is used, for example, thereby ensuring that the same code is not used more than once.

The group code 152 is a code assigned in common to each of the plurality of alarm devices that form a group. When the group code contained in the event signal received from one of the other alarm devices by the wireless circuit section 130 matches the group code 152 registered in the memory 146, this event signal is received and processed as a valid signal.

In the present embodiment, the memory 146 is used in the storage circuit section 132, but by providing a DIP switch (not shown) instead of the memory 146, the transmission source code 150 and the group code 152 can be set by this DIP switch. When the transmission source code 150 and the group code 152 have a short code length (bit count), employing a storage circuit section 132 with DIP switches is desired.

In the sensor section 134, a smoke detector section 116 is provided which outputs a smoke detection signal corresponding with the smoke concentration, to the CPU 128. In the sensor section 134, other than the smoke detector section 116, a thermistor which detects the heat of a fire may be provided. Furthermore, in the case of an alarm device that monitors for gas leaks, a gas leak sensor (not shown) is provided in the sensor section 134.

In the alert section 136, a speaker 156 and an LED 122 are provided. The speaker 156 outputs a voice message or audible alarm from a voice synthesizer circuit section (not shown). The LED 122, by blinking, flashing, illuminating, or similar, indicates a failure or an abnormal condition such as a fire.

In the operation section 138, an alarm stop switch 120 is provided. By operating the alarm stop switch 120, the audible alarm being emitted from the alarm device 110-1 can be stopped. In the present embodiment, the alarm stop switch 120 also functions as a test switch.

The alarm stop switch 120 is enabled when an audible alarm is being output from the alert section 136 through the speaker 156. On the other hand, in the normal monitoring status in which no audible alarm is being output, the alarm stop switch 120 functions as a test switch, and when the test switch is pressed, a voice message or the like for testing purposes is output from the alert section 136.

As the battery power supply 140, for example an alkaline battery with a predetermined number of cells is used, and as for battery capacity a battery life of approximately 10 years is ensured by reducing the power consumption of the overall circuitry in the alarm device 110-1 including the wireless circuit section 130.

In the CPU 128, as functionality realized by program execution, a preliminary abnormal condition detection section 158, a preliminary abnormal condition monitoring section 160, and an abnormal condition monitoring section 162 are provided.

The preliminary abnormal condition detection section 158 detects a preliminary abnormal condition when the smoke concentration detected by the smoke detector section 116 provided in the sensor section 134 indicates a high probability of a fire. Specifically, a preliminary abnormal condition level is defined which is lower than the fire level at which a fire is detected, and a preliminary abnormal condition is detected when the smoke detection signal from the sensor section 134 exceeds the preliminary abnormal condition level.

The preliminary abnormal condition monitoring section 160, when the preliminary abnormal condition detection section 158 detects a preliminary abnormal condition, transmits an event signal indicating the preliminary abnormal condition to the other alarm devices 110-2 to 110-5 from the antenna 131 by means of the transmission circuit 142 of the wireless circuit section 130. On the other hand, the preliminary abnormal condition monitoring section 160, upon receiving an event signal indicating a preliminary abnormal condition from one of the other alarm devices 110-2 to 110-5 by means of the reception circuit 144 of the wireless circuit section 130, changes the reception cycle T112 of the reception circuit 144 to a shorter cycle T113.

Furthermore, the preliminary abnormal condition monitoring section 160 may, upon detecting a preliminary abnormal condition, output a warning associated with the preliminary abnormal condition by activating the LED 122 provided in the alert section 136.

In addition, if the preliminary abnormal condition monitoring section 160, after transmitting the event signal indicating the preliminary abnormal condition, no longer detects the preliminary abnormal condition, an event signal is transmitted to the other alarm devices indicating that the preliminary abnormal condition has been resolved. On the other hand, if the preliminary abnormal condition monitoring section 160 receives an event signal indicating that the preliminary abnormal condition has been resolved, after receiving an event signal from one of the other alarm devices indicating a preliminary abnormal condition, and changing the reception cycle T112 of the reception circuit 144 to a shorter cycle T113, the shortened reception cycle T113 is returned to the original cycle T112 to keep power consumption as low as possible.

In the abnormal condition monitoring section 162, upon detecting a fire when the smoke detection signal from the smoke detector section 116 provided in the sensor section 134 exceeds the fire level, an audible alarm indicating a linkage source, for example a siren and "The fire alarm has activated. Please verify.", is output repeatedly from the speaker 156 of the alert section 136, and an event signal indicating the fire alert is transmitted from the antenna 131 by the transmission circuit 142 of the wireless circuit section 130 to the other alarm devices 110-2 to 110-5.

Furthermore, the abnormal condition monitoring section 162, upon receiving an event signal indicating a fire alert from any of the other alarm devices 110-2 to 110-5 via the reception circuit 144 of the wireless circuit section 130, repeatedly outputs an audible alarm indicating a linkage destination, for example a siren and "The fire alarm in another room has activated. Please verify.", from the speaker 156 of the alert section 136.

When the abnormal condition monitoring section 162 detects a fire alarm and outputs the linkage source audible alarm, the LED 122 of the alert section 136 flashes, for example. On the other hand, when the linkage destination audible alarm is output, the LED 122 of the alert section 136 blinks, for example. As a result, the appearance of the LED 122 during a linkage source alarm can be distinguished from the appearance of the LED 122 during a linkage destination alarm. Naturally, the same flashing or blinking behavior can be used by the LED 122 for alarms issued by the linkage source and the linkage destination.

When the abnormal condition monitoring section 162 detects a low battery failure due to a drop in the voltage of the battery power supply 140, an audible failure alarm is output by outputting a low battery alarm in the form of a short beep at 1 minute intervals, for example, and an event signal indicating the failure is transmitted to the other alarm devices 110-2 to 110-5.

Furthermore, the abnormal condition monitoring section 162, upon receiving an event signal indicating a failure from any of the other alarm devices 110-2 to 110-5, performs linked output of an audible failure alarm by intermittently emitting the low battery alarm in the same manner. When reporting this low battery at a linkage destination, the LED 122 may blink in unison with the audible alarm.

Figure 10:
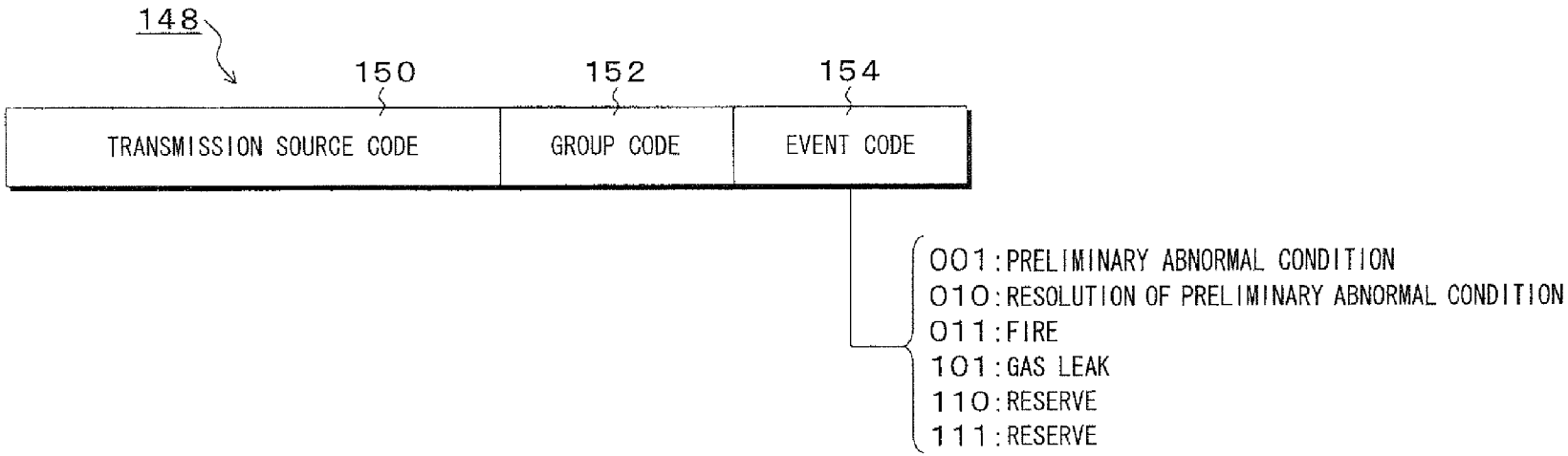
FIG. 10 is an explanatory drawing showing the format of an event signal used in the embodiment.

FIG. 10 is an explanatory drawing showing the format of an event signal used in the present embodiment. As shown in FIG. 10, the event signal 148 comprises a transmission source code 150, a group code 152, and an event code 154. The transmission source code 150 is for example a 26 bit code. The group code 152 is for example, an 8 bit code, and the same group code is assigned to alarm devices in the same group, for example the five alarm devices 110-1 to 110-5 in FIG. 9.

As the group code 152, as an alternative to setting the same group code for the alarm devices in a given group, a group code which is determined by a calculation between a predetermined reference code common to the alarm devices which form a group and a unique transmission source code specific to each alarm device may be set, and thereby a different group code may be used for each alarm device.

The event code 154 is a code that represents the content of the event, such as an abnormal condition like a fire or a gas leak, or a failure. In the present embodiment, a 3 bit code is used; for example, "001" is a preliminary abnormal condition, "010" is resolution of a preliminary abnormal condition, "011" is a fire, and "101" is a gas leak, with the remaining "110" and "111" kept in reserve.

By increasing the number of bits of the event code 154 to 4 bits or 5 bits when the number of event types increases, the event code can represent a plurality of event types.

Figure 11:
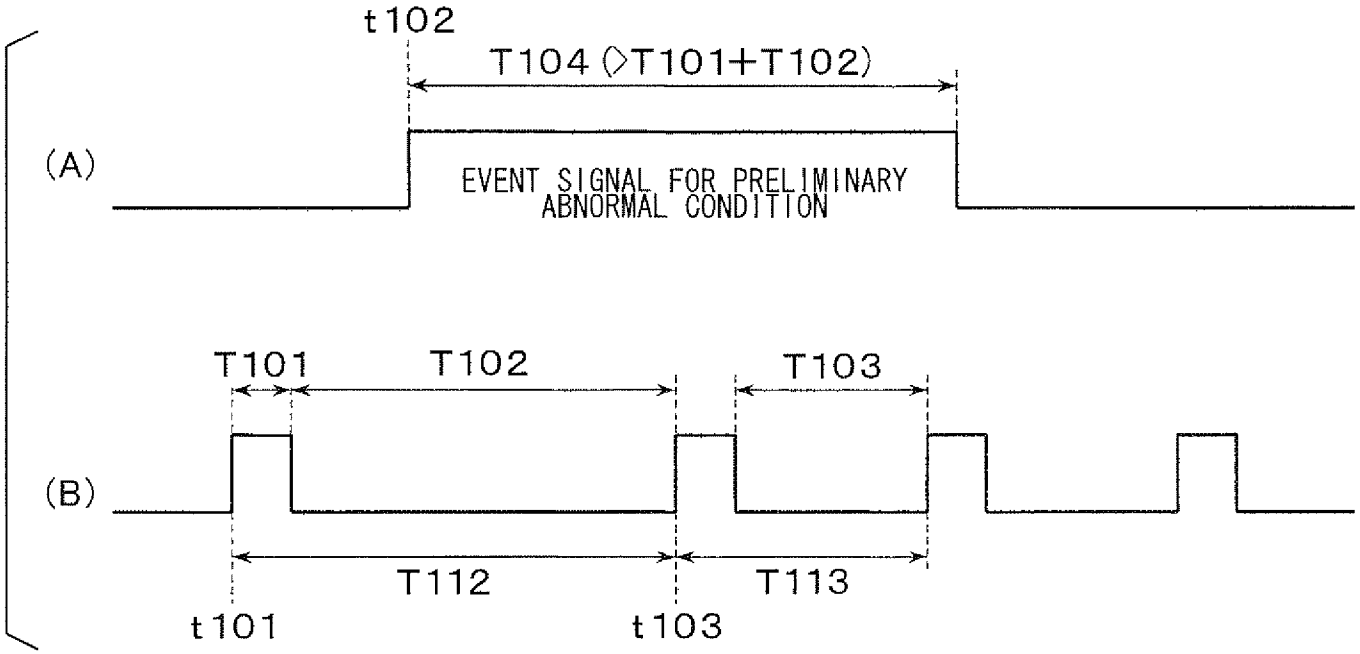
FIG. 11 is a timing chart showing the behavior of the transmission side alarm device (A) and the reception side alarm device (B) when a preliminary abnormal condition is detected in the same embodiment.

FIG. 11 is a timing chart showing the behavior on the transmission side and reception side when a preliminary abnormal condition is detected in the present embodiment. FIG. 11 (A) shows the transmission behavior of the transmission side alarm device, and FIG. 11 (B) shows the reception behavior of the reception side alarm device.

In the reception side alarm device shown in FIG. 11 (B), during the normal monitoring status, intermittent reception behavior is performed at a default intermittent reception cycle T112 (=T101+T102) composed of a reception operation time T101 and a rest time T102. The reception operation time T101 is for example T101=5 milliseconds, and the rest time T102 is for example T102=10 seconds. Accordingly, the intermittent reception time T112 is T112=10 seconds or thereabouts.

In this state, when a preliminary abnormal condition is detected in the transmission side alarm device as shown in FIG. 11 (A), at a time t102 which is the detection timing of the preliminary abnormal condition, for a predetermined duration T104, an event signal 148 having the preliminary abnormal condition "001" shown in FIG. 10 as the event code 154 is repeatedly transmitted on a continuous basis. This transmission and reception time T104 is equal to or greater than the intermittent reception cycle T102.

The event signal, which incorporates the preliminary abnormal condition and is transmitted from the transmission side alarm device with arbitrary timing, is received at the reception operation time beginning at time t103 which occurs after a lapse of the rest time T102 from the reception operation at time t101. When the reception side alarm device receives the event signal incorporating the preliminary abnormal condition, the intermittent reception cycle is changed from the previous cycle T112 to a shorter cycle T113. Here, the new shorter intermittent reception cycle T113 is, for example, T113=3 seconds.

Figure 12:
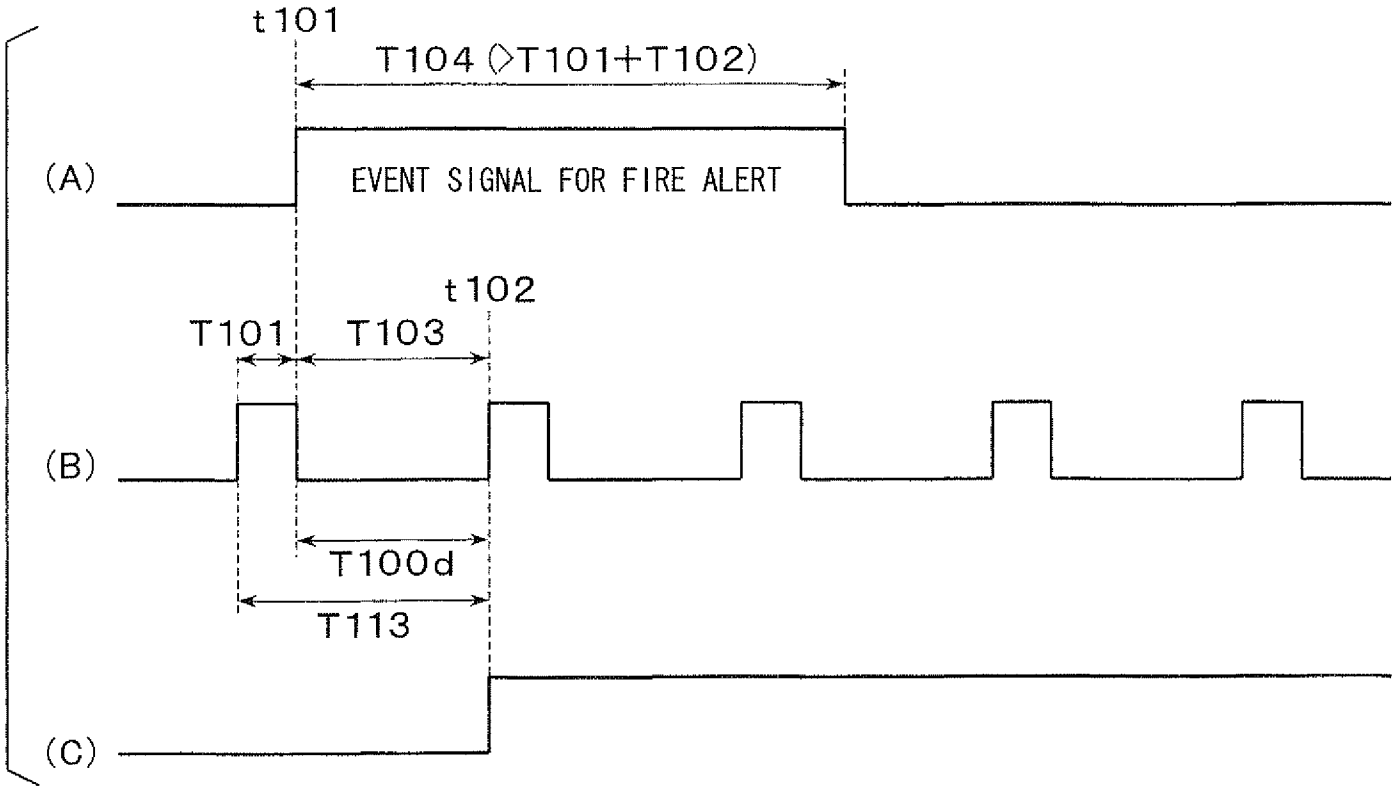
FIG. 12 is a timing chart showing the behavior of the transmission side alarm device (A) and the reception side alarm device (B) when an abnormal condition is detected after a preliminary abnormal condition was detected as shown in FIG. 11. (C) shows alarm output.

FIG. 12 is a timing chart showing the behavior of the transmission side alarm device and the reception side alarm device when an abnormal condition in the form of the fire underlying the preliminary abnormal condition shown in FIG. 11 is detected. In the reception side alarm device shown in FIG. 12 (B), as shown in FIG. 11, the intermittent reception cycle has already been changed to the shorter cycle T113 when the event signal indicating the preliminary abnormal condition was received.

In this state, if the transmission side alarm device shown in FIG. 12 (A) issues a fire alert at a time t101 immediately after the reception operation period and initiates transmission of an event signal indicating the fire alert, this event signal indicating the fire alert is received by the reception operation beginning at time t102 which occurs after a lapse of the rest time T103 from time t101, and the reception side alarm device performs alarm output as shown in FIG. 12 (C).

In this case, the delay time from when the transmission side alarm device detects the fire alert at time 1101 and issues an alarm until the reception side alarm device receives the event signal indicating the fire alert at time t102 and outputs an alarm in a linked manner, is T100*d*. The delay time T100*d* in this situation is substantially equal to the rest time T103 in the intermittent reception cycle.

Therefore, when the event signal for the preliminary abnormal condition is received, the normal intermittent reception cycle T112 is changed to the shorter intermittent reception cycle T113. Then, by the reception side alarm device receiving the event signal indicating a fire alert in this state from the transmission side alarm device and issuing an alarm, even if transmission takes place immediately after the reception operation so as to produce the longest delay time T100*d* shown in FIG. 12, the delay time T100*d* can be kept within the rest time T103 of the new shorter cycle T113.

In other words, in the case of the present embodiment, in contrast to a delay time of approximately 10 seconds when intermittent reception behavior is performed without reception of the preliminary abnormal condition, the delay time can be reduced to approximately 3 seconds or less by changing the intermittent reception cycle to T113 in response to reception of the preliminary abnormal condition.

Figure 13:
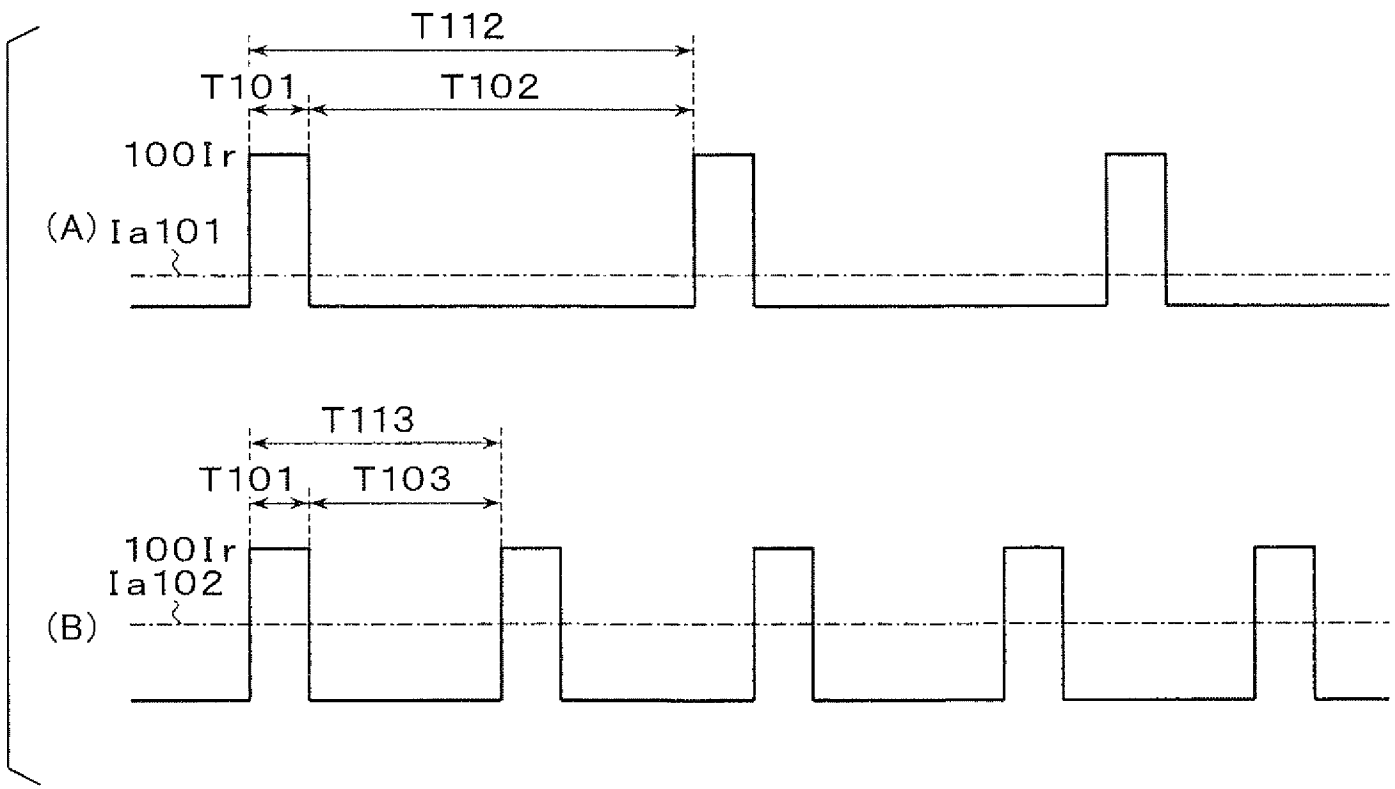
FIG. 13 is a timing chart showing the relationship between the intermittent reception cycle and average consumption current in the embodiment, wherein both (A) and (B) show the reception circuit current.

FIG. 13 is a timing chart showing the relationship between the intermittent reception cycle and the average consumption current in the present embodiment (FIG. 13 (A) and (B) both show the reception circuit current). FIG. 13 (A) shows the intermittent reception behavior at the initially set intermittent reception cycle T112, for which the average current Ia101 can be obtained by the equation (1) below:

$$Ia101=(100Ir\times T101)/T112 \quad (1)$$

FIG. 13 (B) shows a case where the preliminary abnormal condition event signal has been received and the intermittent reception cycle T112 has changed to a shorter intermittent reception cycle T113. The average consumption current Ia102 for this situation can be obtained by the equation (2) below:

$$Ia102=(100Ir\times T101)/T113 \quad (2)$$

Thus, when the intermittent reception cycle T112 is changed to a shorter intermittent reception cycle T113 by the reception of the event signal indicating the preliminary abnormal condition, the average current in the reception circuit increases from Ia101 to Ia102 while this change is in effect.

In this manner, because the average current of the reception circuit increases when the reception cycle is changed to a shorter cycle, in the present embodiment, unnecessary increases in the consumption current of the reception circuit can be suppressed. Therefore, when the transmission side alarm device no longer detects the preliminary abnormal condition, an event signal indicating that the preliminary abnormal condition is resolved is transmitted, and in the reception side alarm device, upon receiving this event signal indicating resolution of the preliminary abnormal condition, the state in which the reception cycle was changed to the shorter intermittent reception cycle T113 reverts to the original longer intermittent reception cycle T112.

Figure 14:
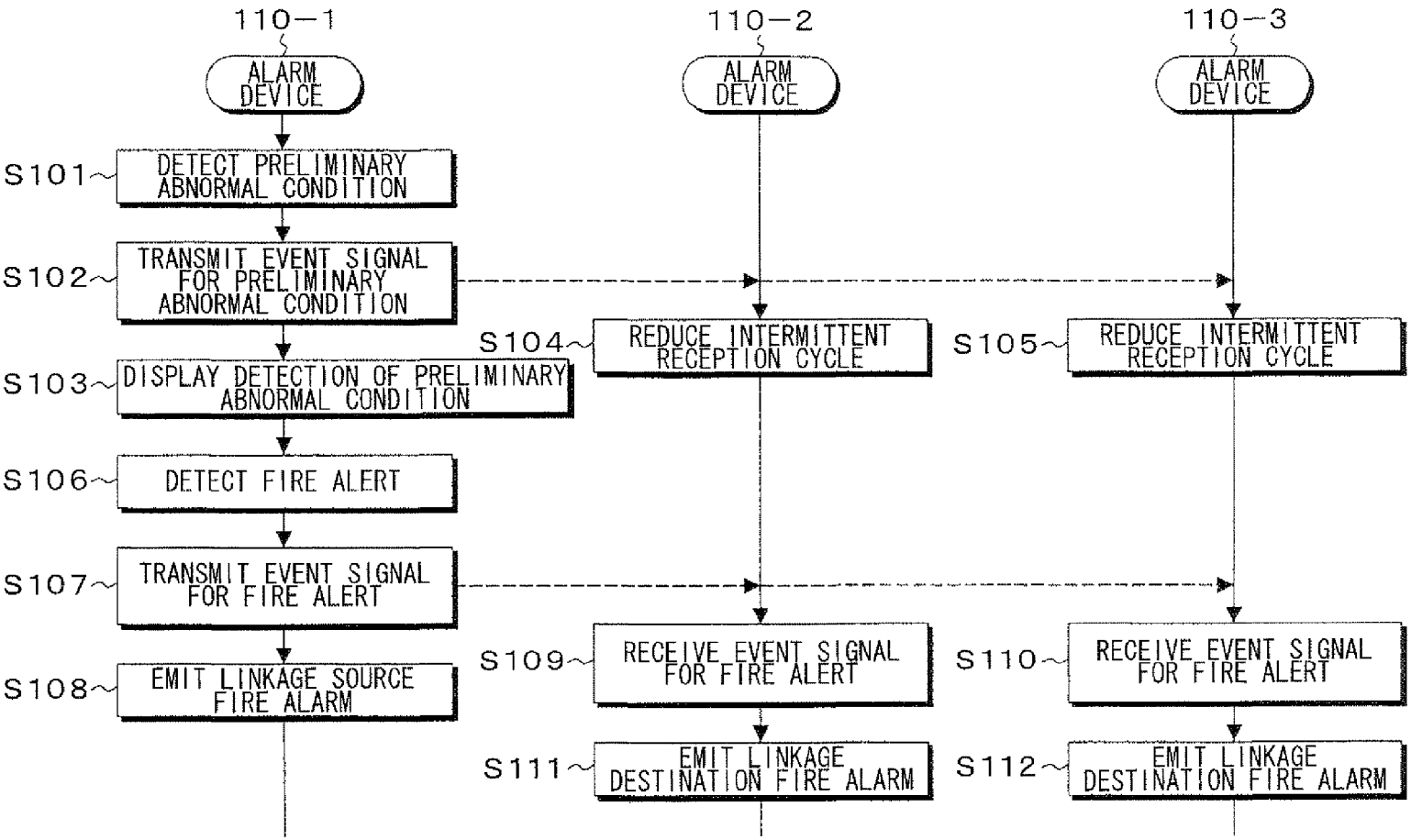
FIG. 14 is a timing chart showing fire monitoring processing in a context of linked alarm output in the present invention.

FIG. 14 is a timing chart showing fire monitoring processing associated with linked alarm output in the present embodiment. To simplify the description, the example uses three alarm devices 110-1 to 110-3.

As shown in FIG. 14, in the alarm device 110-1, in step S101, when the smoke concentration detection signal from the sensor section 134 exceeds a predetermined preliminary abnormal condition level resulting in detection of a preliminary abnormal condition, the flow advances to step S102. The alarm device 110-1 transmits an event signal indicating the preliminary abnormal condition to the alarm devices 110-2 and 110-3 in step S102, and in step S103 displays detection of the preliminary abnormal condition, for example by blinking the LED 122.

The alarm devices 110-2 and 110-3, in steps S104 and S105 respectively, receive the event signal from the alarm device 110-1, identify the preliminary abnormal condition incorporated into the event signal, and change the intermittent reception cycle from the current T112 to the shorter intermittent reception cycle T113.

Then, if the alarm device 110-1 that detected the preliminary abnormal condition detects a fire alert in step S106, the flow advances to step S107 and an event signal indicating the fire alert is transmitted to the alarm devices 110-2 and 110-3. The flow then advances to step S108 and the alarm device 110-1 outputs a fire alarm as a linkage source.

The alarm devices 110-2 and 110-3, in steps S109 and S110, receive the event signal indicating the fire alert from the alarm device 110-1, and output the fire alert as a linkage destination in steps S111 and S112. At this time, because the intermittent reception cycle of the alarm devices 110-2 and 110-3 has changed to the shorter cycle T113, regardless of the timing with which the event signal indicating the fire alert was transmitted from the alarm device 110-1, the delay time from the linkage source fire alert in step S108 until initiation of the linkage destination fire alert in the fire alarms 110-2 and 110-3 in steps S111 and S112 can be kept to a delay time equal to or less than the shorter intermittent reception cycle T113.

Figure 15:
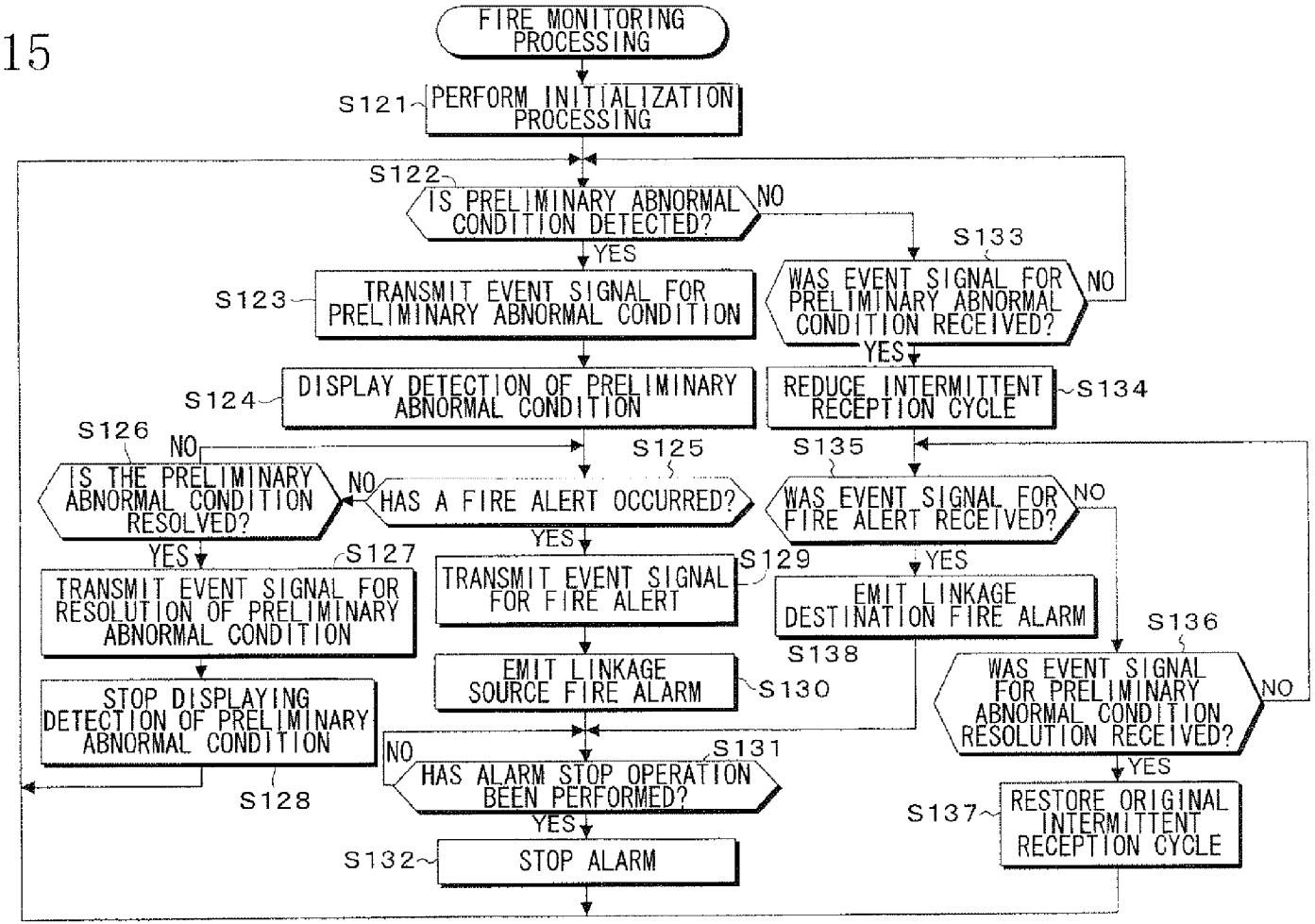
FIG. 15 is a flowchart showing the fire monitoring processing of the present embodiment by means of the CPU shown in FIG. 9.

FIG. 15 is a flowchart showing the fire alert processing of the CPU 128 of the alarm device 110-1 shown in FIG. 9. As shown in FIG. 15, when the battery power source of the alarm device is enabled (switched on), initialization processing takes place in step S121. This initialization processing includes the setting of group codes to form a linked alarm group with the other alarm devices 110-2 to 110-5.

Then, the alarm device 110-1 enters monitoring status, and in step S122 a determination is made as to whether or not a preliminary abnormal condition is detected. In this case, a preliminary abnormal condition is detected when the smoke detection signal from the smoke detector section 116 provided in the sensor section 134 exceeds a predetermined preliminary abnormal condition level, and the flow advances to step S123. In step S123, an event signal for the preliminary abnormal condition is repeatedly transmitted on a continuous basis for a predetermined duration T104 via the antenna 131, from the transmission circuit 142 provided in the wireless circuit section 130 to the other alarm devices 110-2 to 110-5. In the subsequent step S124, detection of the preliminary abnormal condition is displayed, for example by blinking the LED 122 provided in the alert section 136.

Then, in step S125, whether or not a fire alert is warranted is determined based on whether or not the smoke detection signal from the smoke detector section 116 provided in the sensor section 134 exceeds a predetermined fire level. If a determination is made that no fire alert is warranted, the flow advances to step S126 and a determination is made as to whether or not the preliminary abnormal condition remains in effect. If the preliminary abnormal condition is no longer in effect, the flow advances to step S127 and an event signal indicating the resolution of the preliminary abnormal condition is transmitted to the other alarm devices 110-2 to 110-5. The flow then advances to step S128, and display of the preliminary abnormal condition detection is stopped. Subsequently, the flow returns to the processing in step S122.

On the other hand, if a determination is made in step S125 that a fire alert is warranted, the flow advances to step S129, and an event signal for the fire alert is transmitted to the other alarm devices 110-2 to 110-5. Then in step S130, the linkage source fire alarm is output in the form of sound output from the speaker 156 of the alert section 136 and controlled illumination of the LED 122.

After the linkage source fire alarm is performed, a determination is made in step S131 as to whether or not the alarm stop switch 120 has performed an alarm stop operation, and if an alarm stop operation has been performed, the alarm is stopped in step S132.

On the other hand, if a preliminary abnormal condition is not detected in step S122, the flow advances to step S133, and a determination is made as to whether or not an event signal indicating a preliminary abnormal condition was received from any of the other alarm devices. If a determination is made that an event signal indicating a preliminary abnormal condition was received, the flow advances to step S134. In step S134, the intermittent reception cycle is changed from the current cycle T112 to the shorter cycle T113.

After the intermittent reception cycle is changed to the shorter cycle, a check is performed in step S135 to determine whether a fire alert event signal has been received. If a determination is made that a fire alert event signal was received, the flow advances to step S138 and the linkage destination fire alarm is output. Then, if in step S131 an alarm stop operation has been performed, the alarm is stopped in step S132.

Furthermore, in step S135, if no fire alert event signal has been received, the flow advances to step S136 and a check is performed to determine whether a preliminary abnormal condition resolution event signal has been received. If a determination is made that a preliminary abnormal condition resolution event signal has been received, the flow advances to step S137, the original intermittent reception cycle is restored, and the flow returns to the processing in step S122.

Figure 16:
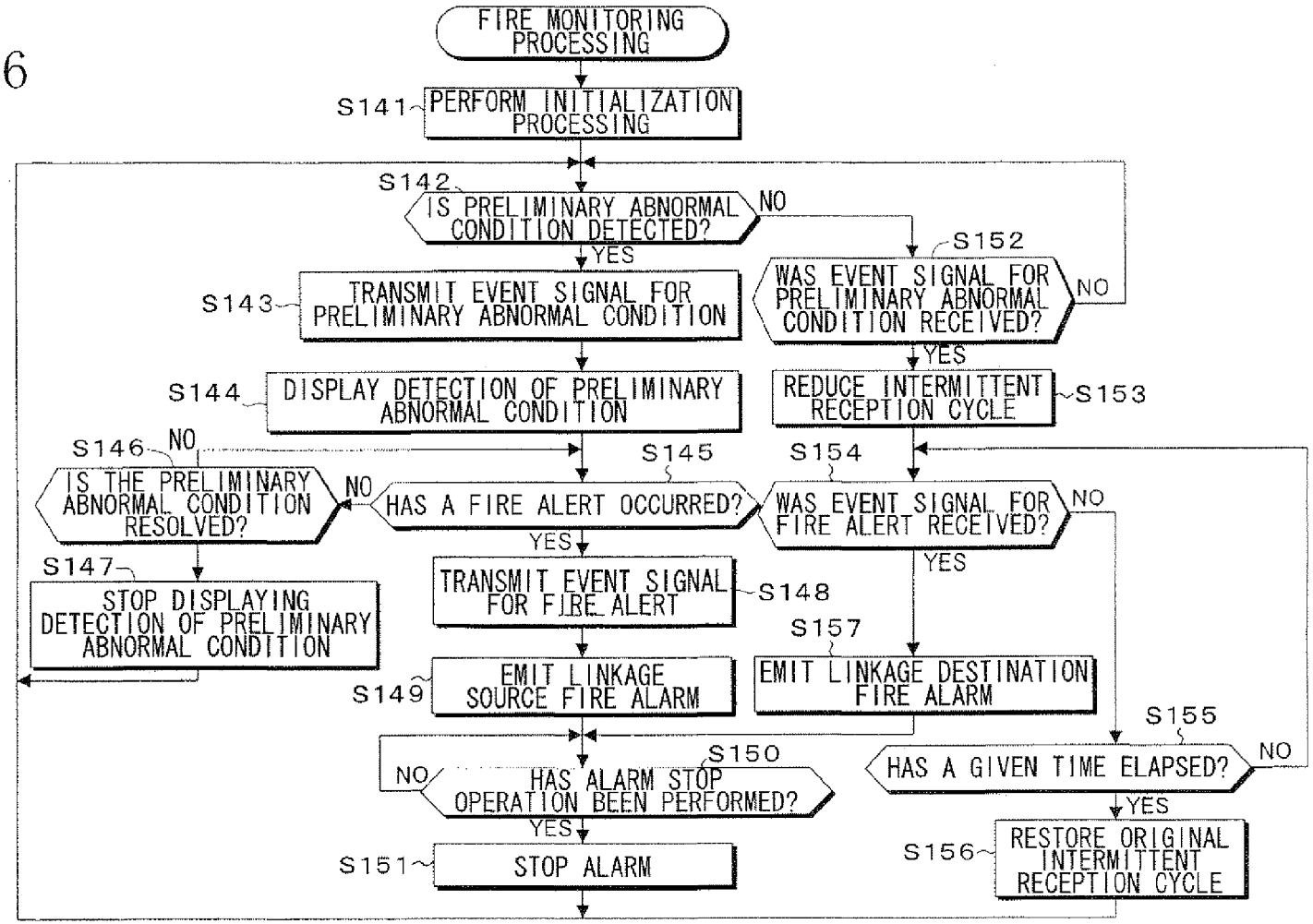
FIG. 16 is a flowchart showing the fire monitoring processing by means of the CPU shown in FIG. 9 in another embodiment.
Figure 17:
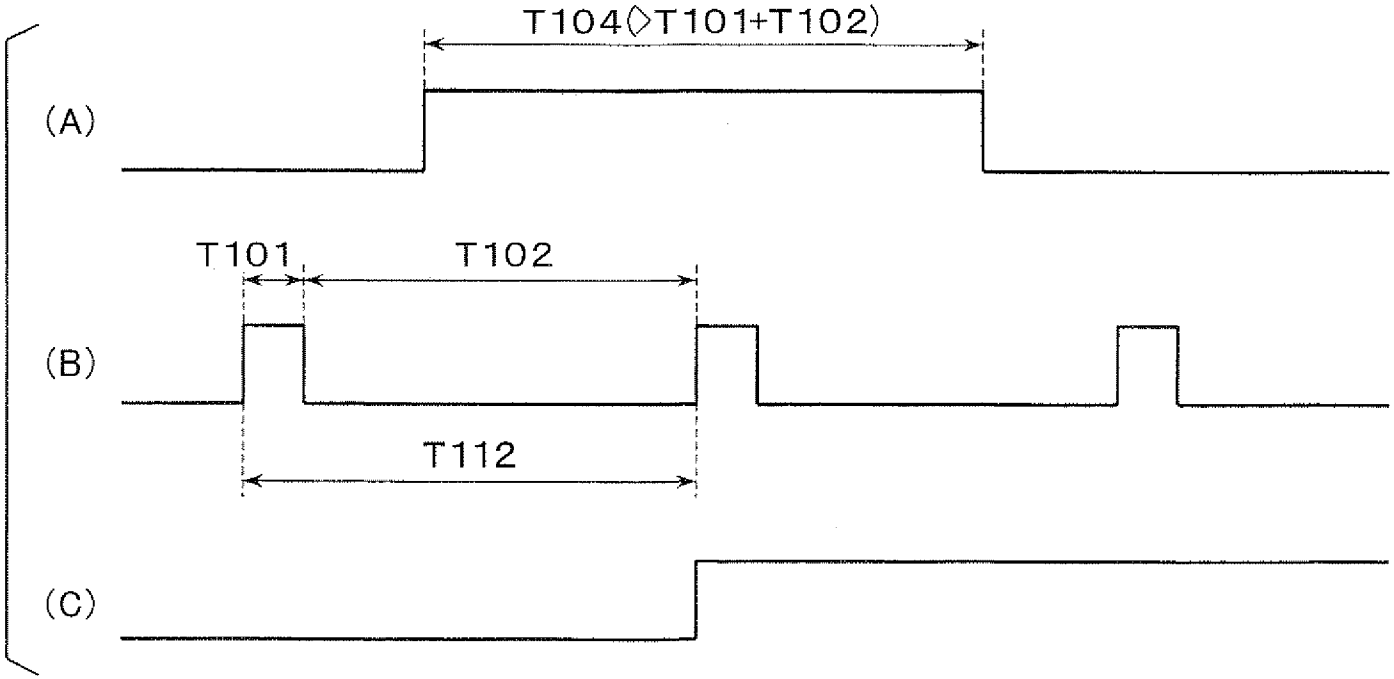
FIG. 17 is a timing chart showing the behavior of the transmission side alarm device (A) and the reception side alarm device (B) for a conventional wireless alarm device. (C) shows alarm output.
Figure 18:
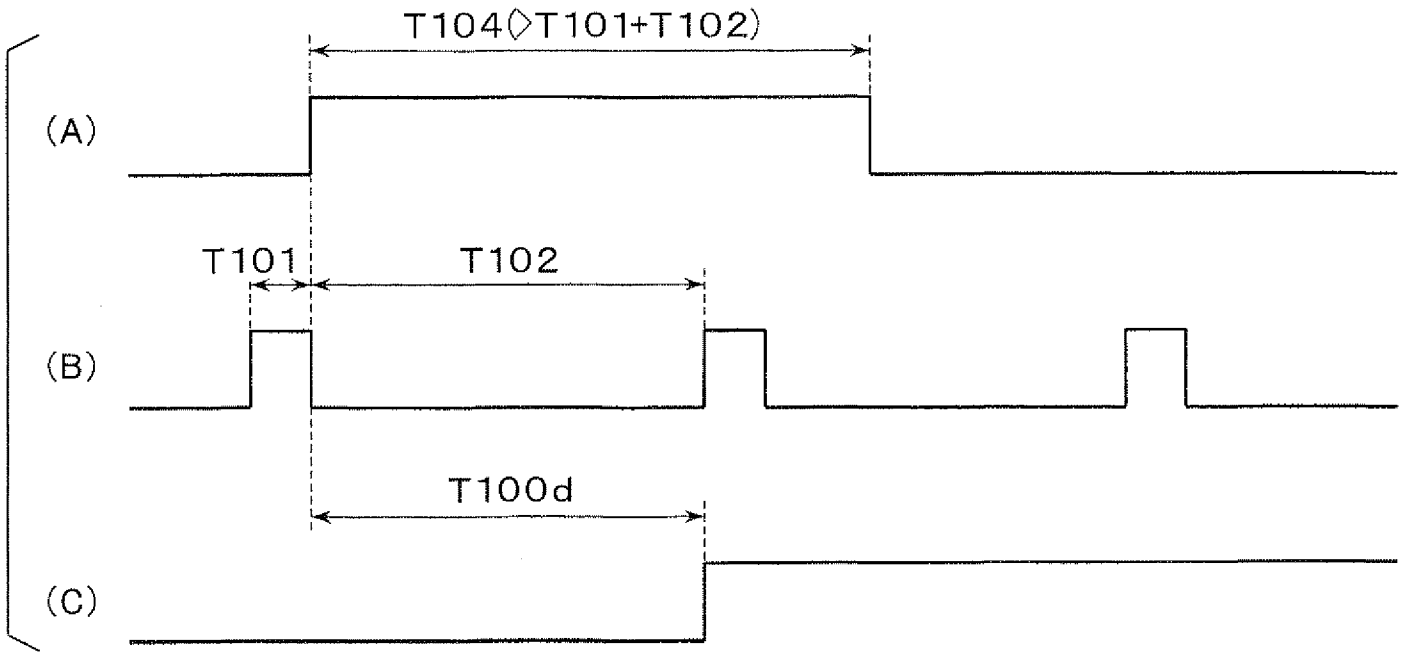
FIG. 18 is a timing chart showing the transmission timing that produces the maximum delay in alarm initiation by the receiving side alarm device (B).

FIG. 16 is a flowchart showing an alternative embodiment of the fire monitoring processing performed by the CPU 128 provided in the alarm device 110-1 shown in FIG. 9. In this embodiment, when the preliminary abnormal condition is resolved in the transmission side alarm device, instead of transmitting a preliminary abnormal condition resolution event signal, after the preliminary abnormal condition event signal is received by the reception side alarm device and the intermittent reception cycle is changed to a shorter cycle, if a fire alert event signal is not received before a given time has elapsed, the original intermittent reception cycle is restored.

In FIG. 16, steps S141 to S146 relating to fire monitoring processing are the same as steps S121 to S126 in FIG. 15. In other words, if a preliminary abnormal condition is detected after the initialization processing performed when the power is turned on, display of preliminary abnormal condition detection is performed after an event signal indicating the preliminary abnormal condition is transmitted. If no fire alert is subsequently warranted then a determination is made as to whether or not to resolve the preliminary abnormal condition. Here, if a judgment is made in step S146 to resolve the preliminary abnormal condition, the flow advances to step S147 and display of preliminary abnormal condition detection is stopped, and in contrast to the embodiment shown in FIG. 15, no event signal indicating preliminary abnormal condition resolution is transmitted.

The processing in steps S148 to S151 for a case when a fire alert is determined to be warranted in step S145 is the same as steps S129 to S132 in FIG. 15.

On the other hand, if a judgment is made in step S142 that no preliminary abnormal condition is detected, the flow advances to step S152 and a check is performed for reception of an event signal indicating a preliminary abnormal condition. If an event signal indicating a preliminary abnormal condition is received, the flow advances to step S153 and the intermittent reception cycle is changed from the current cycle T112 to the shorter cycle T113.

Then, a judgment is made in step S154 as to whether or not a fire alert event signal has been received, and if no fire alert event signal has been received, the flow advances to step S155 and a determination is made based on a timer started at reception of the preliminary abnormal condition event signal, as to whether or not a given time has elapsed. If no fire alert event signal has been received when the time has elapsed, the flow advances to step S156 and the shortened intermittent reception cycle is restored to the original cycle.

Furthermore, if a fire alert event signal is received in step S154, the flow advances to step S157 and a fire alarm is output as a linkage destination.

In this manner, after the reception side alarm device receives a preliminary abnormal condition event signal and changes the intermittent reception cycle to a shorter cycle, if no fire alarm event signal is received by the time the given time elapses, it can then be predicted that the preliminary abnormal condition has been resolved in the transmission side alarm device that detected the preliminary abnormal condition. Accordingly, in this case, to inhibit any increase in power consumption resulting from keeping the intermittent reception cycle in a shortened state any longer, the intermittent reception cycle is returned to the original cycle when a given time has elapsed, thereby suppressing any increase in power consumption beyond what is necessary.

Furthermore, in another embodiment of the present invention, the preliminary abnormal condition monitoring section 160, upon detecting a preliminary abnormal condition, transmits an event signal indicating the preliminary abnormal condition to the other alarm devices, and upon receiving an event signal indicating a preliminary abnormal condition from one of the other alarm devices, changes the behavior of the reception circuit 144 from intermittent reception to constant reception.

In this case, the preliminary abnormal condition monitoring section 160 in the embodiment shown in FIG. 15 changes the reception circuit section from intermittent reception to constant reception when an event signal indicating a preliminary abnormal condition is received from another alarm device. Subsequently, the preliminary abnormal condition monitoring section 160, when an event signal indicating recovery of the preliminary abnormal condition is received, returns the constant reception to the original intermittent reception.

Furthermore, the preliminary abnormal condition monitoring section 160 in the embodiment shown in FIG. 16 changes the intermittent reception of the reception circuit 144 to constant reception when an event signal indicating a preliminary abnormal condition is received from another alarm device. Subsequently, the preliminary abnormal condition monitoring section 160, when a predetermined time has elapsed, returns the constant reception to the original intermittent reception.

In this manner, by switching to constant reception when an event signal indicating a preliminary abnormal condition is received, the event signal for the fire that subsequently occurs can be received without delay, allowing a fire alarm to be issued promptly.

Furthermore, in the embodiments above, an example of an alarm device intended to detect fires was used. However the monitoring processing including preliminary abnormal conditions of the present embodiment can be applied without modification to alarm devices that detect other relevant abnormal conditions, such as gas leak alarms and burglar alarms. Moreover, the present embodiment is applicable not just to residential use, but also to alarm devices with a range of applications in buildings and offices.

Furthermore, in the embodiments above, detection of preliminary abnormal conditions is realized by program execution by means of the CPU. However the sensor section 134 provided in the alarm device may itself incorporate a circuit function which detects and outputs preliminary abnormal conditions.

Moreover, the embodiments described above use an example where the sensor section is integrated with the alarm device. However, as another embodiment, an alarm device in which the sensor section is provided as a separate unit from the alarm device can also be used.

Furthermore, the present invention is not limited to the aforementioned embodiments, and appropriate variations that retain the objectives and advantages thereof are included within its scope. Moreover, the invention is not limited on the basis of the numerical values indicated in the embodiments.

[Fourth Embodiment]

A fourth embodiment of the present invention is described in detail below with reference to the appended drawings.

Figure 19B:
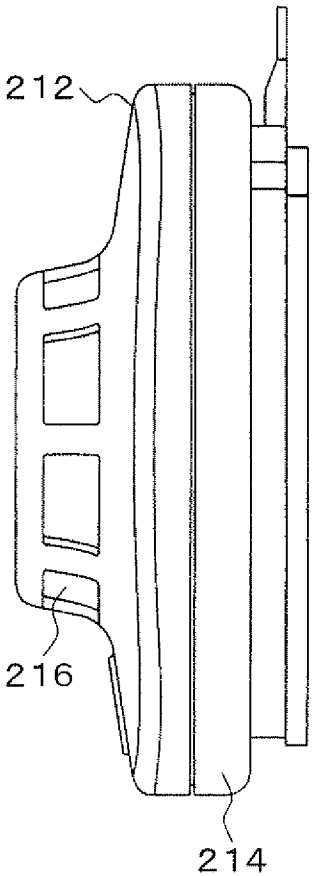
FIG. 19B is a side view of the same alarm device.
Figure 19A:
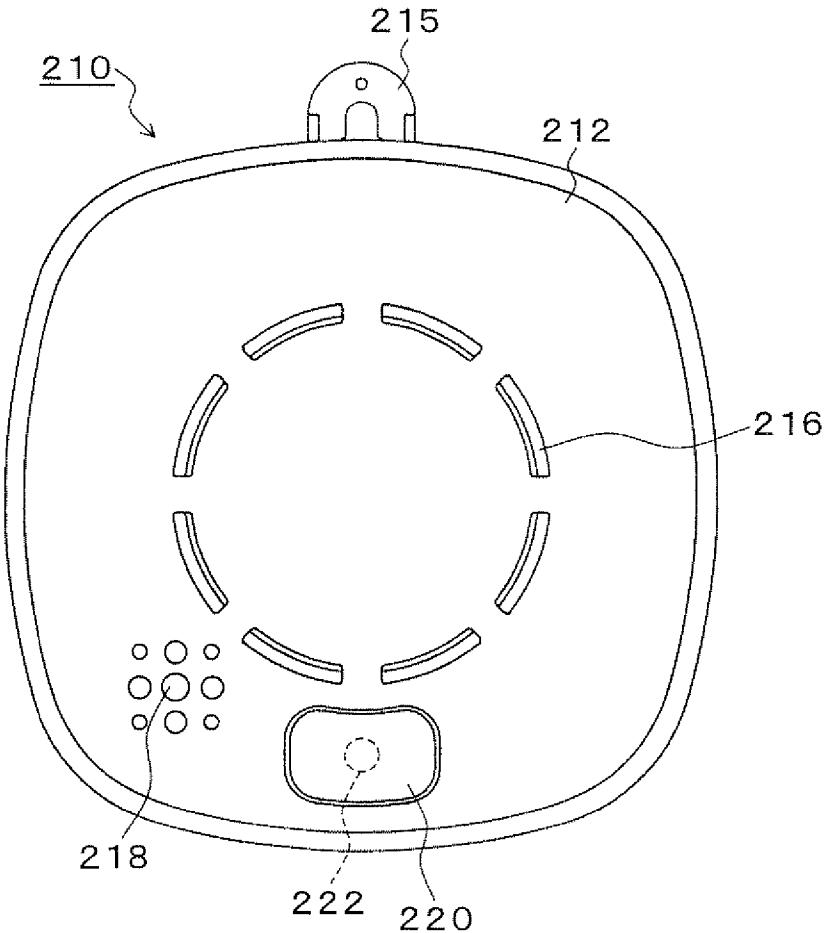
FIG. 19A is a front view of an alarm device of the present invention.

FIG. 19A and FIG. 19B are explanatory drawings showing the outward appearance of a wireless alarm device according to the present embodiment, wherein FIG. 19A shows a front view, and FIG. 19B shows a side view.

As shown in FIG. 19A and FIG. 19B, an alarm device 210 of the present embodiment comprises a cover 212 and a main unit 214. At the center of the cover 212, a smoke detector section 216, having openings through which smoke can enter formed around the periphery thereof, is disposed, which detects a fire when smoke from the fire reaches a predetermined concentration.

At the lower left side of the smoke detector section 216 of the cover 212, a sound hole 218 is provided. A speaker is housed behind this sound hole 218, such that an audible alarm or voice message can be output through the sound hole 218. Underneath the smoke detector section 216, an alarm stop switch 220 is provided. The alarm stop switch 220 also functions as a test switch.

Inside the alarm stop switch 220, an LED 222 is installed as illustrated by the dashed line. When the LED 222 is lit, the lit status of the LED 222 can be recognized from outside through the switch cover of the alarm stop switch 220.

A mounting hook 215 is provided at the top of the back side of the main unit 214. By screwing a screw or the like into a wall of the room where the alarm device 210 is to be installed, and fitting the mounting hook 215 over this screw, the alarm device 210 can be mounted to the wall surface.

Although with the alarm device 210 shown in. FIG. 19A and FIG. 19B, an example of an alarm device comprising the smoke detector section 216 which detects smoke from a fire is used, alarm devices that comprise a thermistor to detect the heat of a fire, or alarm devices that detect gas leaks in addition to fire, are also within the scope of the present invention.

Figure 20:
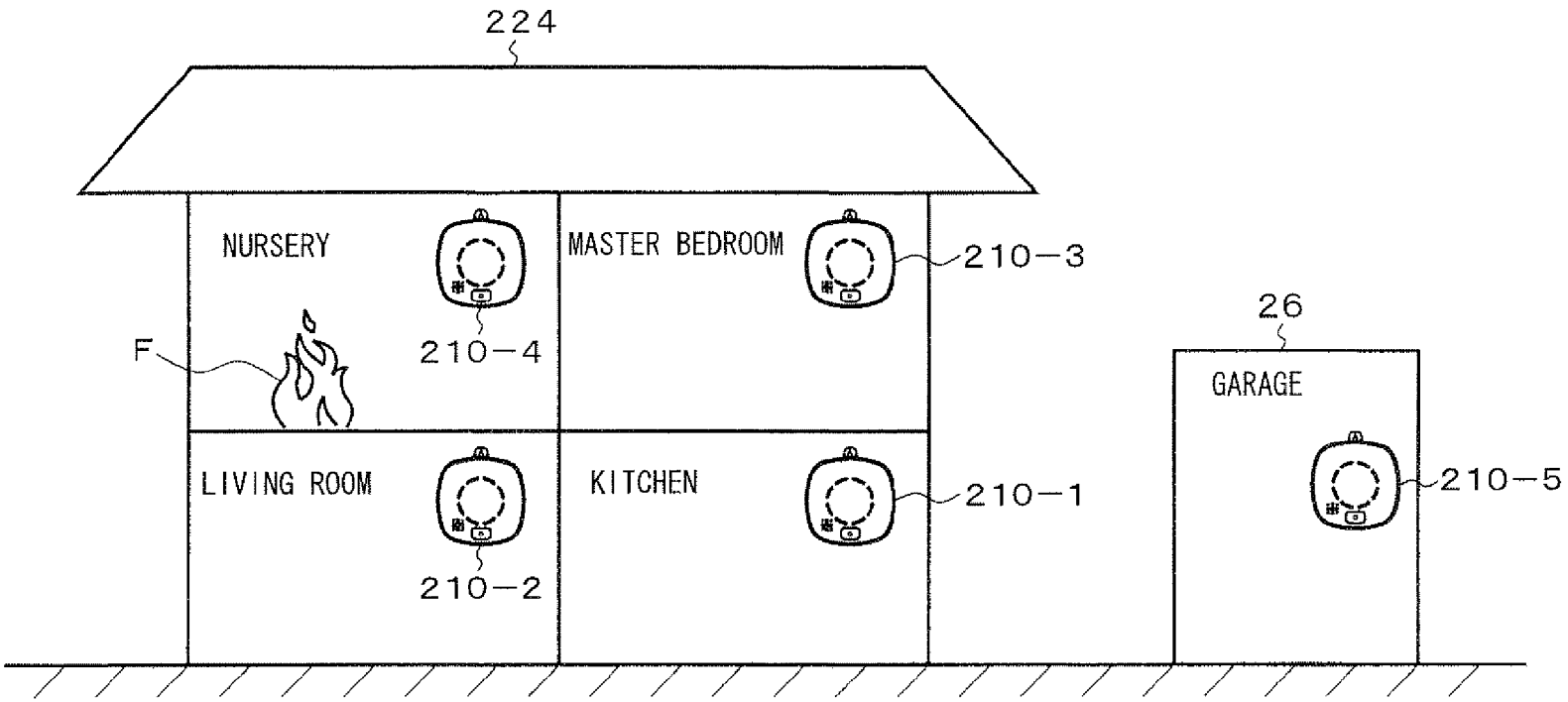
FIG. 20 is an explanatory drawing showing a situation where alarm devices are installed in a residence.

FIG. 20 is an explanatory drawing showing a situation in which alarm, devices of the present embodiment are installed in a residence. In the example in FIG. 20, alarm devices 210-1 to 210-4 of the present embodiment are installed in the kitchen, living room, master bedroom, and nursery of a residence 224 respectively, and an alarm device 210-5 is also installed in an external garage 226.

Each of the alarm devices 210-1 to 210-5 comprises functionality for exchanging event signals with each other by wireless transmission and reception, and the five alarm devices 210-1 to 210-5 form a single group to monitor for fires throughout the entire residence 224.

If a fire occurs in the nursery of the residence 224, the alarm device 210-4 detects the fire and initiates a warning process. Detecting a fire and starting a warning process is called "alert activation" in an alarm device. When the alarm device 210-4 undergoes alert activation, the alarm device 210-4 functions as the linkage source, and to the other alarm devices 210-1 to 210-3 and 210-5 serving as the linkage destinations, wirelessly transmits an event signal indicating the fire alert. The other alarm devices 210-1 to 210-3 and 210-5, upon receiving the event signal indicating the fire alert from the alarm device 210-4 serving as the linkage source, perform alert behavior as a linkage destination.

As the audible alarm of the alarm device 210-4 serving as the linkage source, for example a siren followed by a voice message "The fire alarm has activated. Please verify." may be output continuously. On the other hand, the linkage destination alarm devices 210-1 to 210-3 and 210-5 continuously output a siren followed by a voice message "The fire alarm in another room has activated. Please verify." In a state where the alarm devices 210-1 to 210-5 are outputting an audible alarm, if the alarm stop switch 220 shown in FIG. 19A is operated, processing to stop the audible alarm takes place.

The alarm devices 210-1 to 210-5 comprise failure monitoring functionality, and when a failure is detected, a warning sound, for example a beep, is output intermittently at predetermined intervals to report that a failure has occurred. Furthermore, the failure source alarm device where the failure is detected wirelessly transmits an event signal indicating the failure to the other alarm devices, and the same failure warning is output in the other alarm devices. As a result, when a failure is detected in any of the alarm devices, a failure warning is output from all of the alarm devices that constitute the linked alarm group.

The failure warning output from the alarm devices can be stopped by operating the alarm stop switch 220. In the present embodiment, of the failures detected and reported by an alarm device, a low battery warning which detects and warns of a reduction in the battery voltage in the local alarm device is the most common, and others include warnings of pertinent failures such as the failure of a sensor in a smoke detector section or the like.

In addition, in the alarm devices 210-1 to 210-5 of the present embodiment, when first using the alarm devices 210-1 to 210-5, by performing a predetermined switch operation as necessary to suppress delays in linked alarm output, the intermittent reception cycle during use can be changed from the preset cycle to a shorter cycle.

Figure 21:
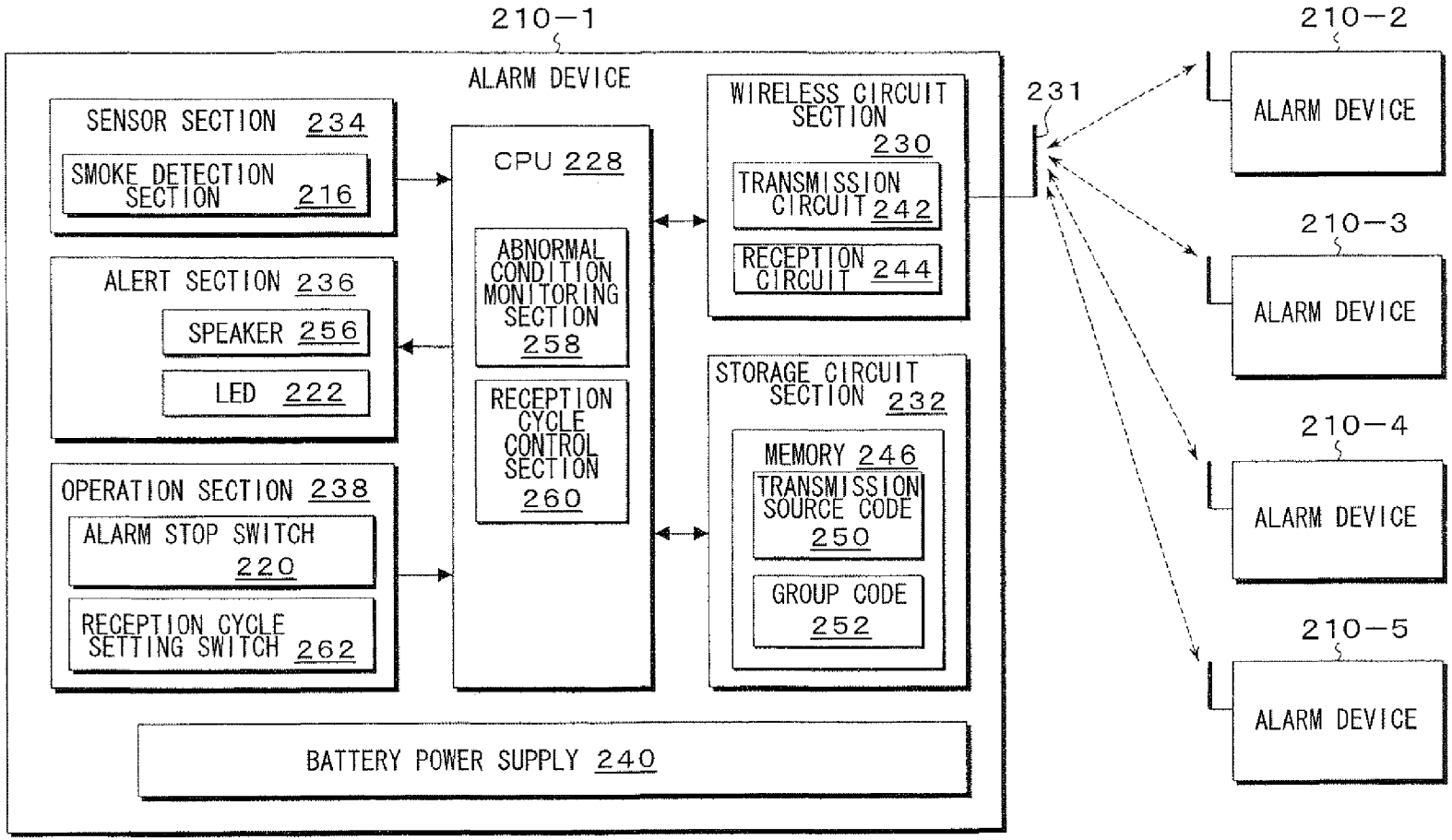
FIG. 21 is a block diagram showing an overview of the construction of the same alarm device.

FIG. 21 is a block diagram showing an alarm device of the present embodiment. Of the five alarm devices 210-1 to 210-5 shown in FIG. 20, FIG. 21 shows in detail the circuit structure for the alarm device 210-1.

The alarm device 210-1 comprises a CPU 228. To this CPU 228 are connected a wireless circuit section 230 comprising an antenna 231, a storage circuit section 232, a sensor section 234, an alert section 236, an operation section 238, and a battery power supply 240.

In the wireless circuit section 230, a transmission circuit 242 and a reception circuit 244 are provided, enabling the wireless transmission and reception of event signals to and from the other alarm devices 210-2 to 210-5. As the wireless circuit section 230, within Japan for instance, preferably a configuration is employed that conforms with STD-30 (a standard for wireless communication equipment in wireless stations for low power security systems) or STD-T67 (a standard for telemeters, telecontrol, and data transmission radio equipment for specified low power radio stations) which are known standards for specified low power radio stations in the 400 MHz band.

Naturally, as the wireless circuit section 230, in locations other than Japan, preferably a configuration is employed that conforms to the standards for allocated wireless base stations in that region.

The reception circuit 244 performs reception on an intermittent basis. The intermittent reception behavior of the reception circuit 244 comprises, for example, a reception period of T201=5 milliseconds followed by a waiting period of T202=10 seconds, yielding intermittent reception in a cycle of T212 (=T201+T202). To accommodate this intermittent reception, the transmission circuit 242 transmits an event signal continuously for a duration of T204 which equals or exceeds the intermittent reception cycle T212 (=T201+T202).

This intermittent reception cycle T212 of the reception circuit 244 is decided at the design stage of the alarm device so as to yield an average consumption current that ensures a battery life of approximately 10 years, for example, and serves as the default cycle set at the factory.

In addition, in the reception circuit 244 of the present embodiment, the preset default intermittent reception cycle T212, by a user operating a reception cycle setting switch 262 provided on the operation section 238 when starting use of the alarm device, can be changed to a shorter intermittent reception cycle T213 to suppress delay in linked alarm output.

In the storage circuit section 232, a memory 246 is provided. In the memory 246 are stored a transmission source code 250 which serves as an ID for identifying the alarm device, and a group code 252 for forming a group of a plurality of alarm devices as shown in FIG. 20 which perform linked alarm output. As the transmission source code 250, based on the estimated number of alarm devices to be supplied throughout the country, a 26 bit code is used, for example, thereby ensuring that the same code is not used more than once.

The group code 252 is a code assigned in common to each of the plurality of alarm devices that form a group. When the group code contained in the event signal received from one of the other alarm devices by the wireless circuit section 230 matches the group code 252 registered in the memory 246, this event signal is received and processed as a valid signal.

In the present embodiment, the memory 246 is used in the storage circuit section 232, but by providing a DIP switch (not shown) instead of the memory 246, the transmission source code 250 and the group code 252 can be set by this DIP switch. When the transmission source code 250 and the group code 252 have a short code length (bit count), employing a storage circuit section 232 based on DIP switches is desired.

In the sensor section 234, a smoke detector section 216 is provided which outputs a smoke detection signal corresponding with the smoke concentration, to the CPU 228. In the sensor section 234, other than the smoke detector section 216, a thermistor which detects the heat of a fire may be provided. Furthermore, in the case of an alarm device that monitors for gas leaks, a gas leak sensor is provided in the sensor section 234.

In the alert section 236, a speaker 256 and an LED 222 are provided. The speaker 256 outputs a voice message or audible alarm from a voice synthesizer circuit section (not shown). The LED 222, by blinking, flashing, illuminating, or similar, indicates a failure or an abnormal condition such as a fire.

In the operation section 238, an alarm stop switch 220 and a reception cycle setting switch 262 are provided. By operating the alarm stop switch 220, the audible alarm being emitted from the alarm device 210-1 can be stopped. In the present embodiment, the alarm stop switch 220 also functions as a test switch.

The alarm stop switch 220 is enabled when an audible alarm is being output from the alert section 236 through the speaker 256. On the other hand, in the normal monitoring status in which no audible alarm is being output, the alarm stop switch 220 functions as a test switch, and when the test switch is pressed, a voice message or the like for testing purposes is output from the alert section 236.

The reception cycle setting switch 262 can be operated when a user starts using the alarm device. This switch issues an instruction to change to the shorter intermittent reception cycle T213 to suppress delays in linked alarm output.

As the battery power supply 240, for example an alkaline battery with a predetermined number of cells is used, and as for battery capacity a battery life of approximately 10 years is ensured by reducing the power consumption of the overall circuitry in the alarm device 210-1 including the wireless circuit section 230.

In the CPU 228, as functionality realized by program execution, an abnormal condition monitoring section 258 and a reception cycle control section 260 are provided.

In the abnormal condition monitoring section 258, upon detecting a fire when the smoke detection signal from the smoke detector section 216 provided in the sensor section 234 exceeds the level of fire, an audible alarm indicating a linkage source, for example a siren and "The fire alarm has activated. Please verify.", is output repeatedly from the speaker 256 of the alert section 236, and an event signal indicating the fire alert is transmitted from the antenna 231 by the transmission circuit 242 of the wireless circuit section 230 to the other alarm devices 210-2 to 210-5.

The abnormal condition monitoring section 258, upon receiving an event signal indicating a fire alert from any of the other alarm devices 210-2 to 210-5 via the reception circuit 244 of the wireless circuit section 230, continuously outputs an audible alarm indicating a linkage destination, for example a siren and "The fire alarm in another room has activated. Please verify.", from the speaker 256 of the alert section 236.

Here, when the abnormal condition monitoring section 258 detects a fire alarm and outputs the linkage source audible alarm, the LED 222 of the alert section 236 flashes, for example. On the other hand, when the linkage destination audible alarm is output, the LED 222 of the alert section 236 blinks, for example. As a result, the appearance of the LED 222 during a linkage source alarm can be distinguished from the appearance of the LED 222 during a linkage destination alarm. Naturally, the same flashing or blinking behavior can be used by the LED 222 for alarms issued by the linkage source and the linkage destination.

When the abnormal condition monitoring section 258 detects a low battery failure due to a drop in the voltage of the battery power supply 240, an audible failure alarm is output by outputting a low battery alarm in the form of a short beep at 1 minute intervals, for example, and an event signal indicating the failure is transmitted to the other alarm devices 210-2 to 210-5.

Furthermore, the abnormal condition monitoring section 258, upon receiving an event signal indicating a failure from any of the other alarm devices 210-2 to 210-5, performs linked output of an audible failure alarm by intermittently emitting the low battery alarm in the same manner. When reporting this low battery at a linkage destination, the LED 222 may blink in unison with the audible alarm.

The reception cycle control section 260, in the initialization processing of the CPU 228 immediately after the battery power supply is enabled (turned on), reads the switch status of a reception cycle setting switch 262 in the form of a DIP switch or the like provided in the operation section 238, that is whether the status of the switch signal indicates that cycle setting mode is off or on. If cycle setting mode is off, the preset intermittent reception cycle T212 is maintained, and if cycle setting mode is on, the preset intermittent reception cycle T212 is changes to the shorter intermittent reception cycle T213.

Figure 22:
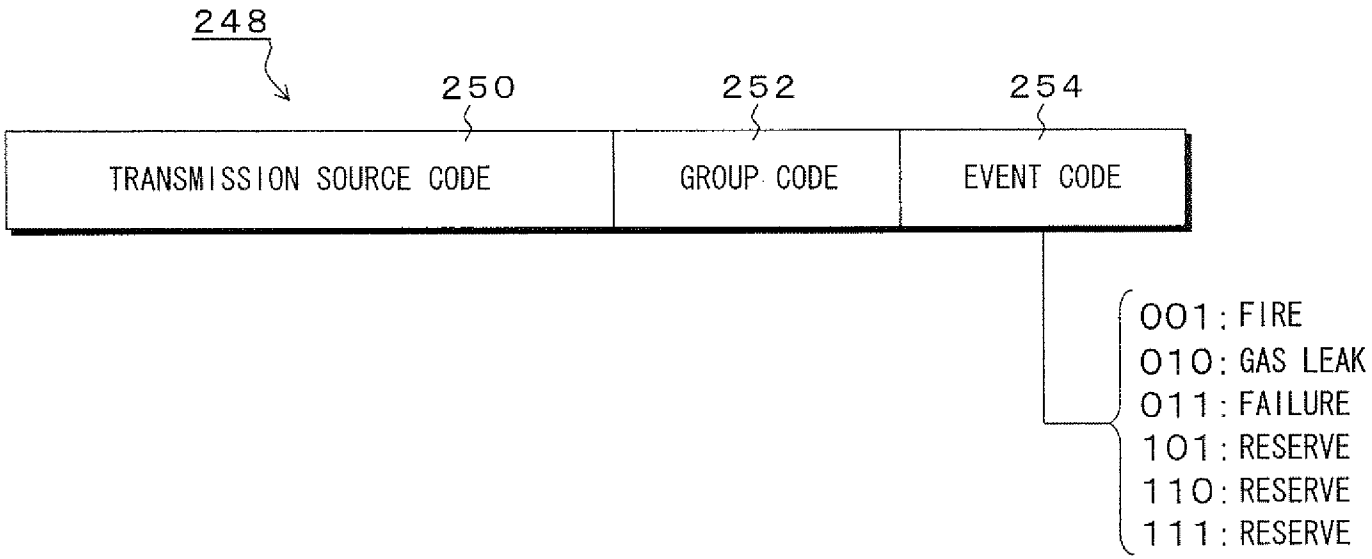
FIG. 22 is an explanatory drawing showing the format of an event signal used in the embodiment.

FIG. 22 is an explanatory drawing showing the format of an event signal used in the present embodiment. In FIG. 22, the event signal 248 comprises a transmission source code 250, a group code 252, and an event code 254. The transmission source code 250 is for example a 26 bit code. The group code 252 is for example an 8 bit code, and the same group code is assigned to alarm devices in the same group, for example the five alarm devices 210-1 to 210-5 in FIG. 21.

As the group code 152, as an alternative to setting the same group code for the alarm devices in a given group, a group code which is determined by a calculation between a predetermined reference code common to the alarm devices which form a group and a unique transmission source code specific to each alarm device may be set, and thereby a different group code may be used for each alarm device.

The event code 254 is a code that represents the content of the event, such as an abnormal condition like a fire or a gas leak, or a failure. In the present embodiment, a 3 bit code is used; for example, "001" is a fire, "010" is a gas leak, and "011" is a failure, with the remainder kept in reserve.

By increasing the number of bits of the event code 254 to 4 bits or 5 bits when the number of event types increases, the event code can represent a plurality of event types.

Figure 23:
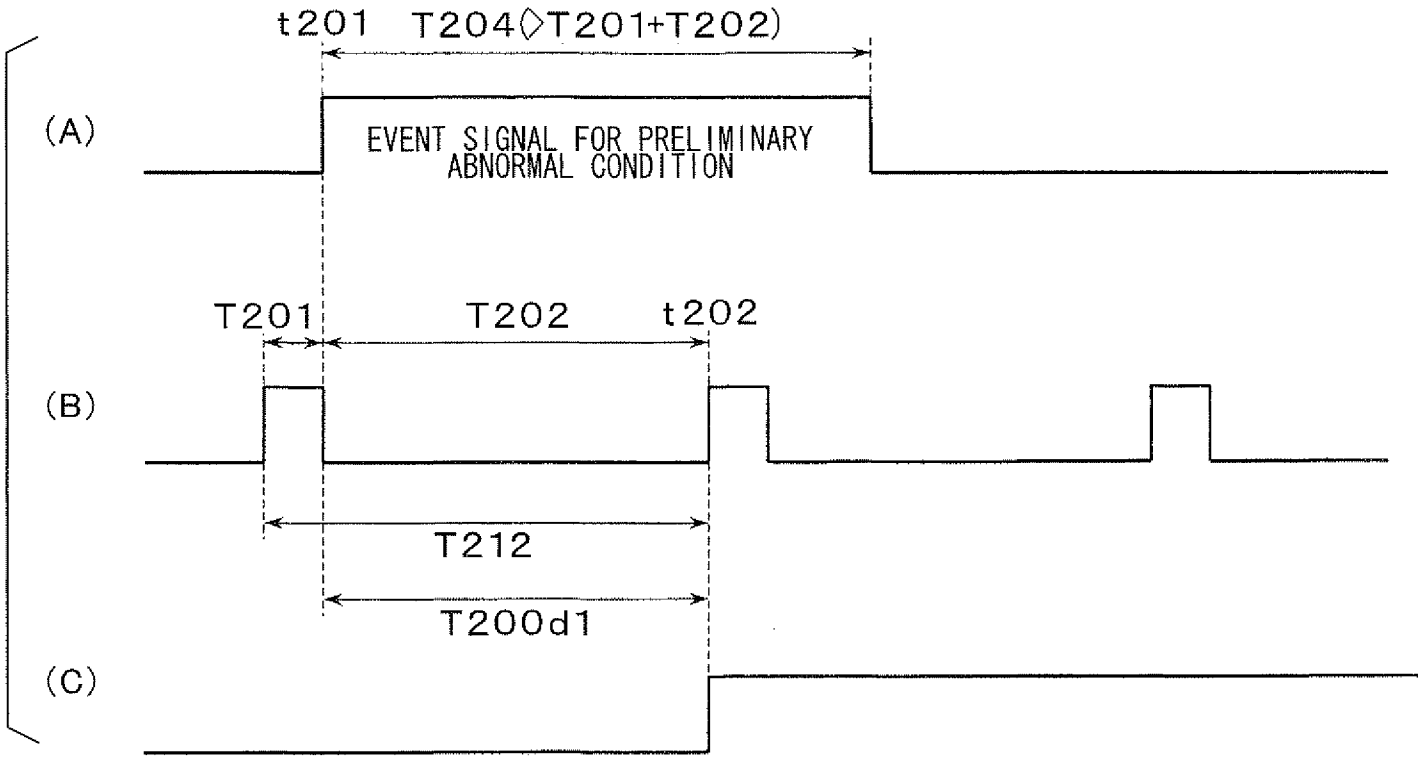
FIG. 23 is a timing chart showing the behavior of the transmission side and reception side in the embodiment with the initial intermittent reception cycle setting.

FIG. 23 is a timing chart showing the behavior on the transmission side and reception side according to the preset intermittent reception cycle T212 in the present embodiment. FIG. 23 (A) shows the transmission behavior of the transmission side alarm device, and FIG. 23 (B) shows the reception behavior of the reception side alarm device.

In the reception side alarm device shown in FIG. 23 (B), during the normal monitoring status, intermittent reception behavior is performed at a default intermittent reception cycle T212 (=T201+T202) composed of a reception operation time T201 and a rest time T202. The reception operation time T201 is for example T201=5 milliseconds, and the rest time T202 is for example T202=10 seconds. Accordingly, the intermittent reception cycle T212 is T212=1.0 seconds or thereabouts.

In this state, suppose that the transmission side alarm device shown in FIG. 23 (A) issues a fire alert at a time t201 immediately after the reception operation period and initiates transmission of an event signal indicating the fire alert. In this case, the event signal indicating the fire alert is received by the reception operation beginning at t202 which occurs after a lapse of the rest time T202 from time t201, and as shown in FIG. 23 (C), the reception side alarm device performs alarm output.

The linkage delay time T200*d*1 in this case is within the rest time T202 of the intermittent reception, and is for example T200*d*1=10 seconds or thereabouts.

Figure 24:
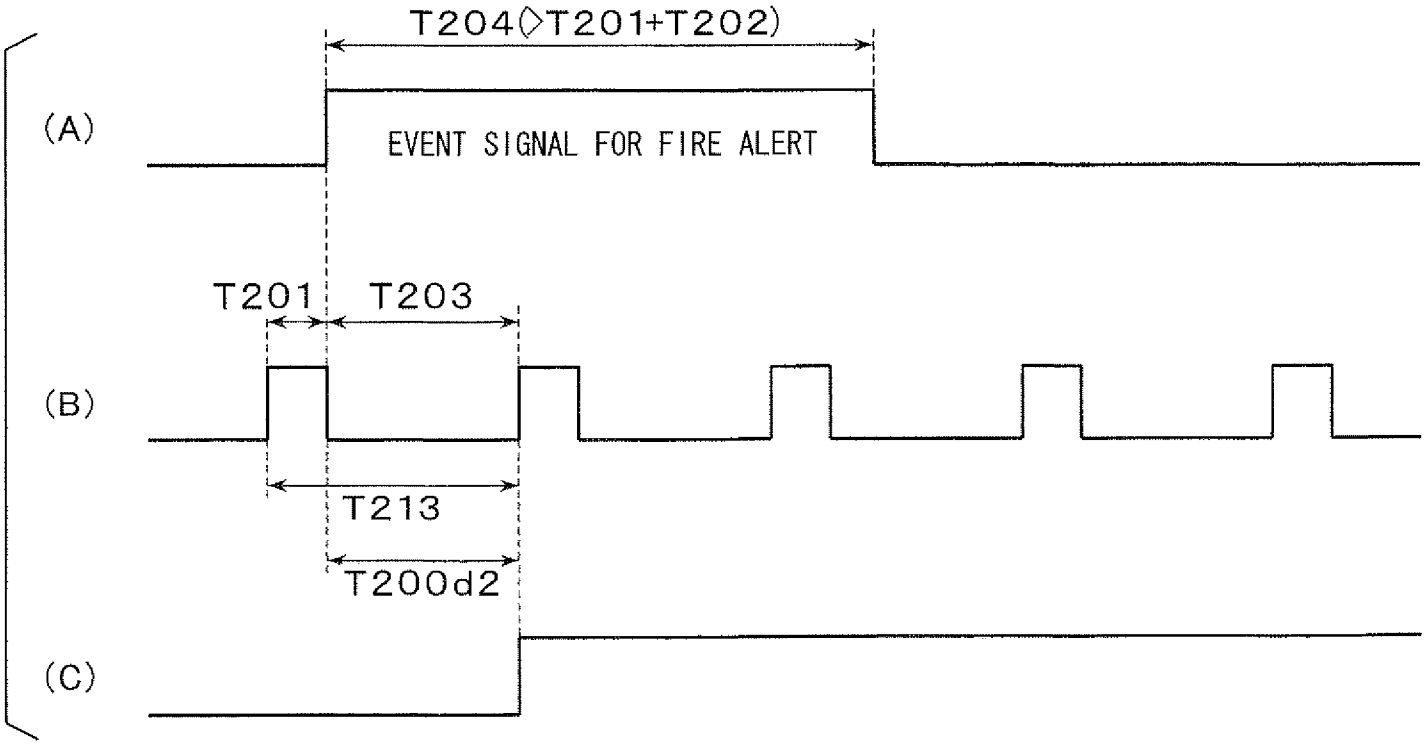
FIG. 24 is a timing chart showing the behavior of the transmission side alarm device (A) and the reception side alarm device (B) in the embodiment when the intermittent reception cycle is changed to a shorter setting. (C) shows alarm output.

FIG. 24 is a timing chart showing the behavior on the transmission side and reception side when the preset intermittent reception cycle T212 is changed to the shorter intermittent reception cycle T213. FIG. 24 (A) shows the transmission behavior of the transmission side alarm device, and FIG. 24 (B) shows the reception behavior of the reception side alarm device.

In the reception side alarm device shown in FIG. 24 (B), in accordance with the operation to change the reception cycle setting, intermittent reception behavior is performed at the intermittent reception cycle T213 (=T201=T203) composed of the reception operation time T201 and a rest time T203. The reception operation time T201 is for example T201=5 milliseconds, and the rest time T203 is for example T203=3 seconds.

The linkage delay time T200*d*2 in this case is within the rest time T203 of the shortened intermittent reception cycle T213, and is for example T200*d*2=3 seconds or thereabouts.

Figure 25:
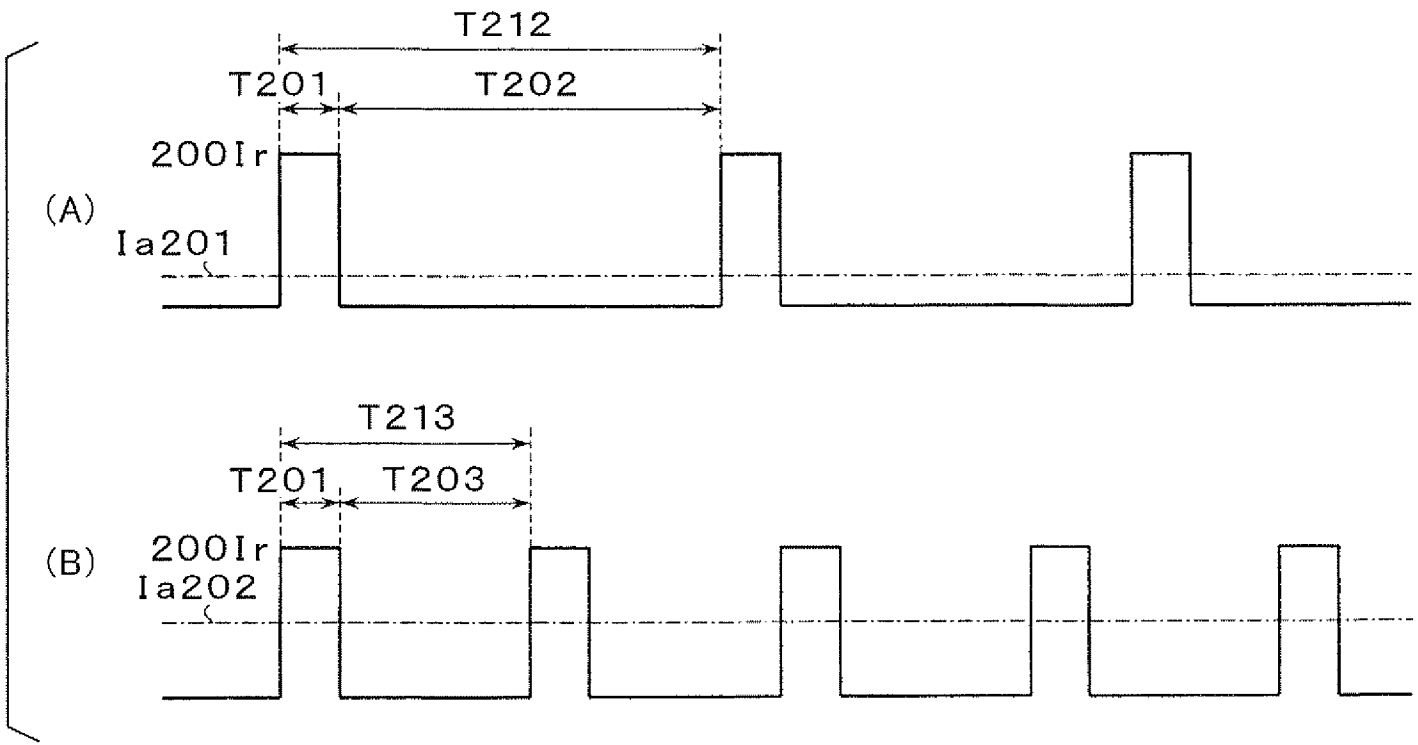
FIG. 25 is a timing chart showing the relationship between the intermittent reception cycle and average consumption current in the embodiment, wherein both (A) and (B) show the reception circuit current.

FIG. 25 is a timing chart showing the relationship between the intermittent reception cycle and average consumption current in the present embodiment.

FIG. 25 (A) shows the intermittent reception behavior (reception circuit current) at the unchanged preset intermittent reception cycle T212, for which the average current Ia201 can be obtained by the equation (3) below:

$$Ia201=(200Ir\times T201)/T212 \quad (3)$$

FIG. 25 (B) shows a case where based on a setting operation, the intermittent reception cycle T212 has been changed to a shorter intermittent reception cycle T213. The average consumption current Ia202 for this situation can be obtained by the equation (4) below:

$$Ia202=(200Ir\times T201)/T213 \quad (4)$$

Thus, by changing the intermittent reception cycle T212 to a shorter intermittent reception cycle T213 by a user operation, time delay is suppressed for linked alarm output, but the average current in the reception circuit increases from Ia201 to Ia202.

Figure 26:
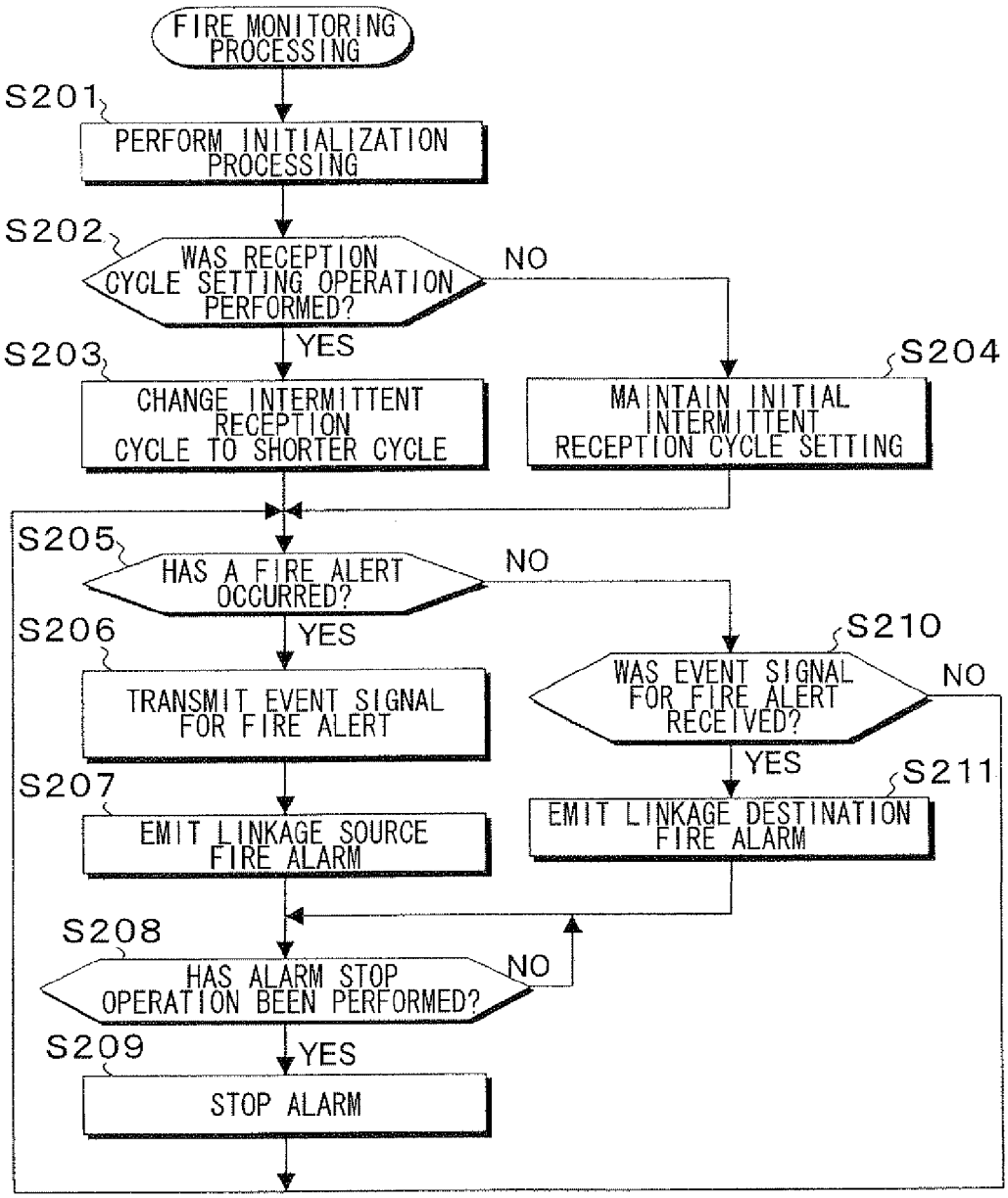
FIG. 26 is a timing chart showing fire monitoring processing in a context of linked alarm output.
Figure 27:
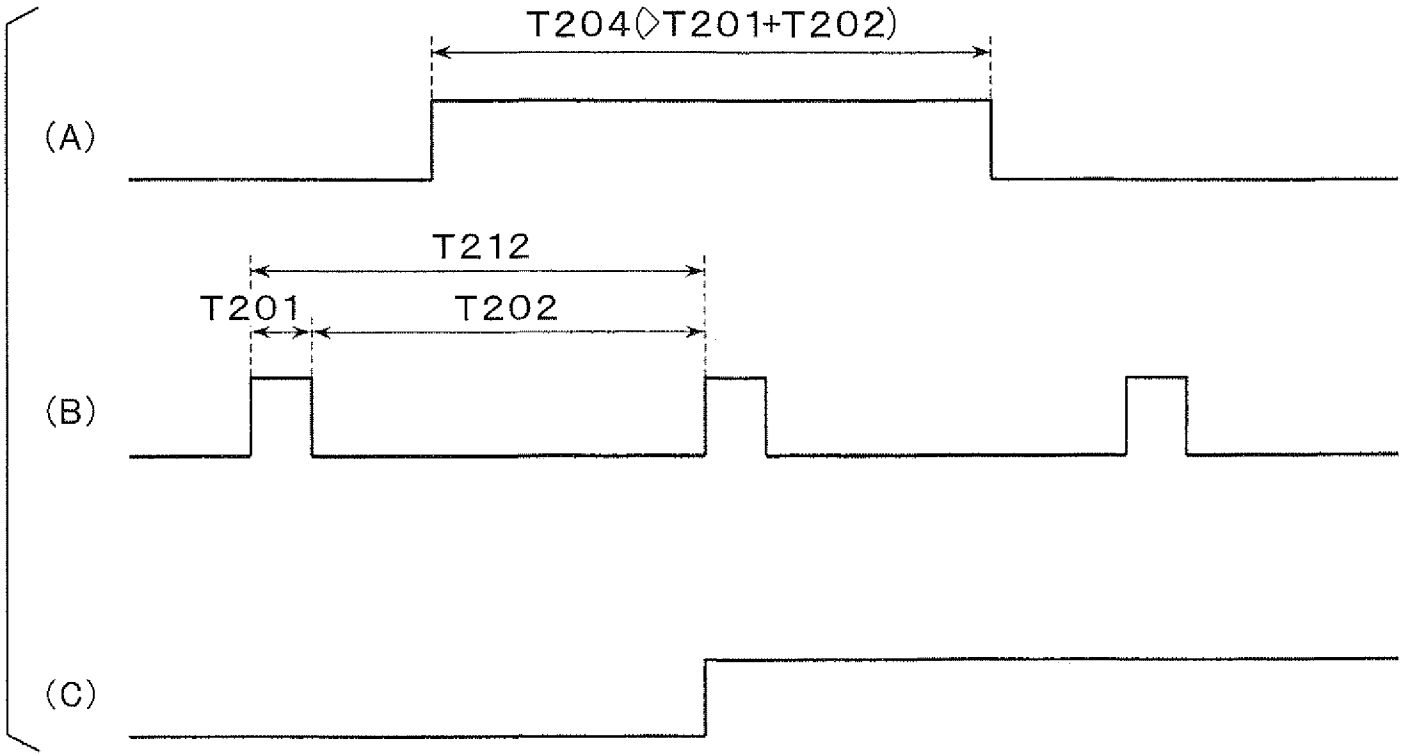
FIG. 27 is a timing chart showing the behavior of the transmission side alarm device (A) and the reception side alarm device (B) for a conventional wireless alarm device. (C) shows alarm output.
Figure 28:
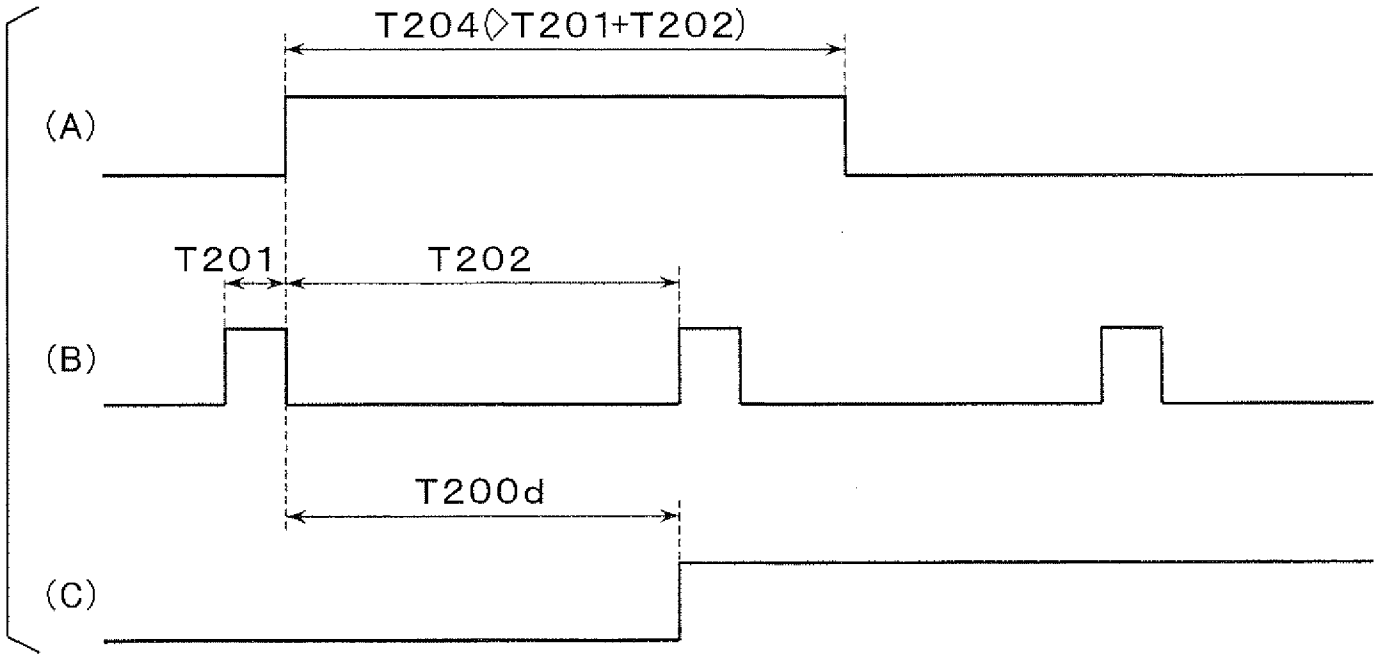
FIG. 28 is a timing chart showing the transmission timing that produces the maximum delay in alarm initiation by the receiving side alarm device (B). (A) shows the behavior of the transmission side alarm device, and (C) shows alarm output by the receiving side alarm device.

FIG. 26 is a flowchart showing the fire monitoring processing performed by the CPU 228 provided in the alarm device 210-1 shown in FIG. 21. In FIG. 26, when the battery power source of the alarm device is enabled (switched on), initialization processing takes place in step S201. Then, in step S202, the switch status of the reception cycle setting switch 262 provided in the operation section 238 is read, and if the switch is on, a judgment is made that a reception cycle setting operation has been performed and the flow advances to step S203. In step S203, the intermittent reception cycle of the reception circuit 244 is changed from the preset cycle T212 to the shorter cycle T213.

On the other hand, in step S202, if the switch status of the reception cycle setting switch 262 is off, the flow advances to step S204, and the intermittent reception cycle retains the initial setting T212.

Then, the alarm device enters monitoring status, and in step S205 a determination is made based on the smoke detector section 216 provided in the sensor section 232, as to whether or not a fire alert is warranted. If a judgment is made that a fire alert is warranted, the flow advances to step S206, and an event signal for the fire alert is transmitted to the other alarm devices 210-2 to 210-5. Then, in step S207 the linkage source fire alarm is output in the form of sound output from the speaker 256 of the alert section 236 and controlled illumination of the LED 222.

After the linkage source fire alarm is performed, a determination is made in step S208 as to whether or not the alarm stop switch 230 has performed an alarm stop operation, and if an alarm stop operation has been performed, the alarm is stopped in step S209.

On the other hand, if a judgment is made in step S205 that no fire alert is warranted, the flow advances to step S210, and a determination is made as to whether or not a fire alert event signal has been received from any of the other alarm devices 210-2 to 210-5. If a determination is made that a fire alert event signal has been received, the flow advances to step S211 and a fire alarm is output as a linkage destination.

At this time, if the intermittent reception cycle is the initially set T212, then as shown by the timing chart in FIG. 23, the linked alarm delay time T200*d*1 is a time within 10 seconds or thereabouts, which conforms to the rest time T202. On the other hand, if the intermittent reception cycle setting was changed to T213, then as shown by the timing chart in FIG. 24, the linked alarm delay time T200*d*2 is shortened to a time within 3 seconds or thereabouts, which conforms to the rest time T203.

The flow then advances to step S208, and if an alarm stop operation was performed, the alarm is stopped in step S209.

The operation to change the intermittent reception cycle to a shorter cycle can be performed for all or some of the alarm devices that constitute the linked group shown in FIG. 20 and FIG. 21. For example, by shortening the intermittent reception cycle for the alarm device 210-2 installed in the living room where people are present, a mode of use can be realized whereby delays in linked alarm output are minimized when a fire alert is issued by an alarm device in another room.

Furthermore, in the embodiments above, an example of an alarm device intended to detect fires was used. However the monitoring processing including preliminary abnormal conditions of the present embodiment can be applied without modification to alarm devices that detect other relevant abnormal conditions, such as gas leak alarms and burglar alarms. Moreover, the present embodiment is applicable not just to residential use, but also to alarm devices with a range of applications in buildings and offices.

Moreover, the embodiments described above use an example where the sensor section is integrated with the alarm device. However, as another embodiment, an alarm device in which the sensor section is provided as a separate unit from the alarm device can also be used.

Furthermore, the present invention is not limited to the aforementioned embodiments, and appropriate variations that retain the objectives and advantages thereof are included within its scope. Moreover, the invention is not limited on the basis of the numerical values indicated in the embodiments.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

The alarm device and alarm system according to the present invention can be applied to an alarm device and alarm system which detect an abnormal condition within a monitoring area and output an alarm, and are of particular utility in an alarm device and alarm system which suppress a lack of synchronization in the timing of alarm output, between an alarm device that transmits the alarm signal, and the alarm devices that receive the alarm signal.

What is claimed is:

1. An alarm system that detects an abnormal condition within a monitoring area and outputs an alarm, comprising:

an alarm device comprising:

a detection device which detects an occurrence of the abnormal condition;

a transmission device which transmits an alarm signal when the detection device detects the abnormal condition; and an output device which, after the transmission device has transmitted the alarm signal, outputs the alarm after a lapse of a predetermined time after the transmission; and a reception apparatus comprising a reception section which receives the alarm signal, and an output section which when the reception section receives the alarm signal, outputs the alarm at substantially the same time as reception of the alarm signal, wherein the predetermined time is set so as to be equivalent to the time taken from transmission of the alarm signal by the transmission device to reception of the alarm signal by the reception section.

2. The alarm system according to claim 1, wherein the output device outputs the alarm at a first volume at substantially the same time as transmission of the alarm signal by the transmission device, and then changes the volume of the alarm from the first volume to a different second volume when the predetermined time has elapsed since transmission of the alarm signal.

3. The alarm system according to claim 1, wherein the detection device further comprises a display device which displays an alarm when the detection device detects the abnormal condition.

4. The alarm system according to claim 1, wherein the alarm device and the reception apparatus form an integral construction; and a plurality of such integrally constructed alarm devices and reception apparatuses are provided.

5. An alarm device comprising:

a reception circuit section which receives event signals from other alarm devices by performing intermittent reception behavior at a predetermined reception cycle;

a transmission circuit section which transmits event signals to the other alarm devices for a transmission time whose duration is equal to or longer than the predetermined reception cycle;

a sensor section which detects an abnormal condition;

an alert section which outputs an alarm;

an abnormal condition monitoring section which upon receiving an abnormal condition detection signal from the sensor section, outputs an abnormal condition alarm itself as a linkage source, and transmits an event signal indicating the abnormal condition to the other alarm devices, and on the other hand, upon receiving an event signal indicating the abnormal condition from one of the other alarm devices, outputs an abnormal condition alarm to the other alarm devices serving as a linkage destination;

a preliminary abnormal condition detection section which detects a preliminary abnormal condition when the sensor section detects that the probability of an abnormal condition occurring is greater than a predetermined probability; and a preliminary abnormal condition monitoring section which, when the preliminary abnormal condition is detected, transmits an event signal indicating the preliminary abnormal condition to the other alarm devices, and on the other hand, upon receiving an event signal indicating the preliminary abnormal condition from one of the other alarm devices, either changes the reception cycle of the reception circuit section to a shorter cycle, or changes the reception behavior of the reception circuit section to constant reception.

6. An alarm device according to claim 5, wherein the preliminary abnormal condition monitoring section is provided in the sensor section.

7. An alarm device according to claim 5, wherein the preliminary abnormal condition monitoring section, upon detecting the preliminary abnormal condition, outputs a preliminary abnormal condition alarm from the alert section.

8. An alarm device according to claim 5, wherein, the preliminary abnormal condition monitoring section, after the event signal indicating the preliminary abnormal condition is transmitted, if the preliminary abnormal condition is no longer detected, transmits an event signal indicating resolution of the preliminary abnormal condition to the other alarm devices, and on the other hand, after either the reception cycle of the reception circuit section is changed to a cycle shorter than the predetermined reception cycle, or the reception behavior of the reception circuit section is changed to constant reception upon receiving an event signal indicating the preliminary abnormal condition from one of the other alarm devices, when the event signal indicating the resolution of the preliminary abnormal condition is received, either restores the reception cycle to the predetermined cycle, or restores the reception behavior of the reception circuit section from the constant reception to the original intermittent reception.

9. An alarm device according to claim 5, wherein the preliminary abnormal condition monitoring section, when a predetermined time has elapsed since receiving the event signal indicating the preliminary abnormal condition from one of the other alarm devices and either changing the reception cycle of the reception circuit section to a shorter cycle than the predetermined reception cycle, or changing the reception behavior of the reception circuit section to constant reception, either restores the reception cycle to the predetermined cycle or restores the reception behavior of the reception circuit section from the constant reception to the original intermittent reception.

10. An alarm device comprising:

a reception circuit section which receives event signals from other alarm devices by performing intermittent reception behavior at a predetermined reception cycle;

a transmission circuit section which transmits event signals to the other alarm devices for a transmission time equal to or longer than the predetermined reception cycle;

a sensor section which detects an abnormal condition;

an alert section which outputs an alarm;

an abnormal condition monitoring section which upon receiving an abnormal condition detection signal from the sensor section, outputs an abnormal condition alarm itself as a linkage source, and transmits an event signal indicating the abnormal condition to the other alarm devices, and on the other hand, upon receiving an event signal indicating the abnormal condition from one of the other alarm devices, outputs an abnormal condition alarm to the other alarm devices serving as a linkage destination;

and a reception cycle control section which, by a predetermined setting operation, changes a reception cycle of the reception circuit section to a shorter cycle than the predetermined cycle.

* * * * *